US010053284B2

(12) United States Patent
Dunn et al.

(10) Patent No.: US 10,053,284 B2
(45) **Date of Patent: *Aug. 21, 2018**

(54) CONTAINER FOR RECEIVING MULTIPLE FLEXIBLE BAG ASSEMBLIES

(71) Applicant: Munchkin, Inc., Van Nuys, CA (US)

(72) Inventors: Steven Bryan Dunn, Beverly Hills, CA (US); Mark A. Hatherill, Beverly Hills, CA (US); Kevin D. Johnson, Tarzana, CA (US); Matthew Joseph Saxton, Agoura, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 181 days.

This patent is subject to a terminal disclaimer.

(21) Appl. No.: 14/967,253

(22) Filed: Dec. 11, 2015

(65) Prior Publication Data

US 2016/0167873 A1 Jun. 16, 2016

Related U.S. Application Data

(60) Provisional application No. 62/090,558, filed on Dec. 11, 2014.

(51) Int. Cl.

| | |
|---|---|
| ***B65F 1/06*** | (2006.01) |
| ***B65B 9/15*** | (2006.01) |
| ***B65F 1/16*** | (2006.01) |

(52) U.S. Cl.

CPC ..... *B65F 1/062* (2013.01); *B65F 1/163* (2013.01); *B65F 1/1615* (2013.01); (Continued)

(58) Field of Classification Search

CPC ..... B65F 1/062; B65F 1/1615; B65F 1/163; B65F 1/1646; B65F 1/12; B65F 1/0006; B65F 2240/132; B65F 2210/129; B65F 2210/1675; B65F 1/06; B65F 2240/164; B65F 2210/167

(Continued)

(56) References Cited

U.S. PATENT DOCUMENTS

| | | | |
|---|---|---|---|
| 1,633 | A | 6/1840 | Sellers et al. |
| 18,046 | A | 8/1857 | Hinckley |

(Continued)

FOREIGN PATENT DOCUMENTS

| | | | |
|---|---|---|---|
| CA | 2366384 | A1 | 6/2003 |
| CA | 2486136 | A1 | 5/2005 |

(Continued)

OTHER PUBLICATIONS

International Search Report and Written Opinion for PCT/US2013/029555 dated Jul. 9, 2013 (pp. 1-10).

(Continued)

*Primary Examiner* — J. Gregory Pickett
*Assistant Examiner* — Gideon Weinerth
(74) *Attorney, Agent, or Firm* — Robert Z. Evora, Esq.; Christian Lek; Fariborz Moazzam, Esq.

(57) ABSTRACT

Containers are described which can accommodate a variety of flexible bag assemblies used for containing waste. Internal accommodating structures are designed to accommodate and secure various types of bag assemblies, including single bag assemblies and cassettes.

19 Claims, 40 Drawing Sheets

(52) U.S. Cl.
CPC . *B65F 2001/1669* (2013.01); *B65F 2210/129* (2013.01); *B65F 2210/1675* (2013.01); *B65F 2240/132* (2013.01)

(58) Field of Classification Search
USPC ..... 220/495.05, 495.08, 495.06, 495.09, 220/908.1, 495.1; 53/567; 221/46
See application file for complete search history.

(56) References Cited

U.S. PATENT DOCUMENTS 111,521 A 2/1871 Dodge
293,459 A 2/1884 Hawn
428,228 A 5/1890 Price
459,875 A 9/1891 Locke
471,433 A 3/1892 Rice
486,128 A 11/1892 Scheuer
503,113 A 8/1893 Osterloh
627,434 A 6/1899 Miller
685,179 A 10/1901 Seebers
859,497 A 7/1907 Hood
860,183 A 7/1907 Barr
1,719,185 A 7/1929 Lowy
1,774,589 A 9/1930 Raymond
2,080,402 A 5/1937 Herman
2,271,918 A 2/1942 Glowka
2,352,503 A * 6/1944 Walton ..... B65D 5/5059 206/525
2,810,432 A 9/1952 Ambrose
2,671,906 A 11/1952 Potts
2,989,828 A 6/1961 Warp
3,086,674 A 4/1963 Scheuerman
3,152,576 A 10/1964 Faurot
D201,670 S 7/1965 Moore
3,214,065 A 10/1965 Thornton
3,220,601 A 11/1965 Kasting
3,310,224 A 3/1967 Laguerre
3,321,103 A 5/1967 Phillips
3,322,477 A 5/1967 Armijo
3,376,046 A 4/1968 Kivett et al.
3,401,409 A 9/1968 Ekrut
3,452,368 A 7/1969 Couper
3,478,922 A 11/1969 Mole
3,536,192 A 10/1970 Couper
3,587,843 A 6/1971 Wing
3,602,924 A 9/1971 Kneisley
3,619,822 A 11/1971 Carmichael
3,746,159 A 7/1973 May
3,772,712 A 11/1973 Renn et al.
3,779,157 A 12/1973 Ross, Jr. et al.
3,908,336 A 9/1975 Forslund
3,938,340 A 2/1976 Lovqvist
3,956,510 A 5/1976 Molnar
3,959,947 A 6/1976 Sonnino
4,085,706 A 4/1978 Evans
4,132,047 A 1/1979 Gerigk et al.
4,162,602 A 7/1979 Achelpohl et al.
4,175,603 A 11/1979 Iaboni et al.
4,216,762 A 8/1980 Klaila
4,303,710 A 12/1981 Bullard et al.
4,316,762 A 2/1982 Martin
4,331,254 A 5/1982 Haggerty
4,343,053 A 8/1982 O'Connor
4,349,123 A 9/1982 Yang
4,408,692 A 10/1983 Sigel et al.
4,420,093 A 12/1983 Von Holdt
4,427,110 A 1/1984 Shaw, Jr.
4,437,575 A 3/1984 Hahn
D274,462 S 6/1984 Rakocy et al.
4,505,003 A 3/1985 Becker et al.
4,528,719 A 7/1985 Frey
D279,949 S 8/1985 Rossin
4,561,563 A 12/1985 Woods
4,600,112 A 7/1986 Shillington et al.
4,617,230 A 10/1986 Shah et al.
4,637,061 A 1/1987 Riese
4,687,711 A 8/1987 Vietto et al.
4,721,226 A 1/1988 Yurko
4,724,185 A 2/1988 Shah
4,760,784 A 8/1988 Whiteside
4,786,192 A 11/1988 Graves et al.
D302,753 S 8/1989 Zelinger
4,868,024 A 9/1989 Cross et al.
4,869,049 A 9/1989 Richards
4,880,852 A 11/1989 Hoshino et al.
4,890,934 A 1/1990 Feaver et al.
4,906,495 A 3/1990 Martini et al.
4,934,529 A 6/1990 Richards et al.
4,946,720 A 8/1990 Oishi et al.
4,948,266 A 8/1990 Bencic
4,948,639 A 8/1990 Brooker et al.
4,983,171 A 1/1991 Schirmer
4,996,727 A 3/1991 Wyatt
5,022,553 A 6/1991 Pontius
5,024,327 A 6/1991 Shillington
5,045,020 A 9/1991 Neeff et al.
5,046,219 A 9/1991 Stanley
5,056,293 A 10/1991 Richards et al.
D321,572 S 11/1991 Laden
5,115,935 A 5/1992 Lemongelli
5,116,139 A 5/1992 Young et al.
5,120,454 A 6/1992 Wieties
5,125,526 A 6/1992 Sumanis
5,129,735 A 7/1992 Neal et al.
5,147,055 A 9/1992 Samson et al.
5,158,199 A 10/1992 Pontius
5,174,462 A 12/1992 Hames
5,183,157 A 2/1993 Darden
5,184,575 A 2/1993 Reinartz
D334,975 S 4/1993 Bunce et al.
5,222,620 A 6/1993 Lima et al.
5,230,651 A 7/1993 Farkonas et al.
5,278,282 A 1/1994 Nauman et al.
5,294,017 A 3/1994 Li
D351,606 S 10/1994 Markusson et al.
5,370,940 A 12/1994 Hazlitt et al.
5,382,631 A 1/1995 Stehling et al.
5,385,259 A 1/1995 Bernstein et al.
5,391,423 A 2/1995 Wnuk et al.
5,405,041 A 4/1995 Van Brackle
5,437,376 A 8/1995 Buku
5,520,303 A 5/1996 Bernstein et al.
5,535,913 A 7/1996 Asbach et al.
5,582,820 A 12/1996 Yamamoto et al.
5,590,512 A 1/1997 Richards et al.
5,637,366 A 6/1997 Davis et al.
D380,538 S 7/1997 Muller et al.
D381,472 S 7/1997 Catalano et al.
5,642,810 A 7/1997 Warner et al.
5,651,231 A 7/1997 Garland
5,655,680 A 8/1997 Asbach et al.
D383,864 S 9/1997 Billings
5,671,847 A 9/1997 Paterson et al.
5,692,837 A 12/1997 Beer
5,699,925 A 12/1997 Petruzzi
D391,725 S 3/1998 Triglia
5,752,658 A 5/1998 Gibbs et al.
5,759,648 A 6/1998 Idlas
5,762,421 A 6/1998 Ross
5,765,339 A 6/1998 Garland
5,799,909 A 9/1998 Ziegler
5,813,200 A 9/1998 Jacoby et al.
5,816,431 A 10/1998 Giannopoulos
5,852,114 A 12/1998 Loomis et al.
5,884,556 A 3/1999 Klepacki et al.
5,886,078 A 3/1999 Sullivan et al.
5,897,084 A 4/1999 Judge
5,962,598 A 10/1999 Mack et al.
5,988,520 A 11/1999 Bitner
6,000,323 A 12/1999 Schlegel
6,007,030 A 12/1999 Judge
D424,677 S 5/2000 Chen
6,065,272 A 5/2000 Lecomte
6,071,451 A 6/2000 Wang et al.

(56) References Cited

U.S. PATENT DOCUMENTS

D427,825 S 7/2000 Mooney
6,082,898 A 7/2000 Capy et al.
6,096,420 A 8/2000 Wilhoit et al.
6,116,780 A 9/2000 Young et al.
6,120,743 A 9/2000 Papari
D432,224 S 10/2000 Hautmann et al.
6,128,890 A 10/2000 Firth
6,129,716 A 10/2000 Steer
6,141,945 A 11/2000 Becher
6,147,167 A 11/2000 Mack et al.
6,164,442 A 12/2000 Stravitz
6,164,821 A 12/2000 Randall
6,170,240 B1 1/2001 Jacoby et al.
6,173,851 B1 1/2001 Hague et al.
6,174,990 B1 1/2001 Noda
6,199,220 B1 3/2001 Smith
6,202,877 B1 3/2001 La Torre et al.
6,254,273 B1 7/2001 Galomb et al.
6,258,423 B1 7/2001 Giori
6,296,388 B1 10/2001 Galomb et al.
6,303,220 B1 10/2001 Minamoto et al.
6,316,067 B1 11/2001 Edwards et al.
6,345,911 B1 2/2002 Young et al.
6,354,062 B1 3/2002 Haughton et al.
D455,485 S 4/2002 Hensel
6,370,847 B1 4/2002 Jensen et al.
D458,359 S 6/2002 Blanchette
6,453,640 B1 9/2002 Hayashi
6,494,619 B1 12/2002 Sulpizio
6,516,588 B2 2/2003 Jensen et al.
6,532,605 B1 3/2003 Howell
6,540,103 B2 4/2003 Silvers
D475,444 S 6/2003 Laferriere et al.
6,585,153 B2 7/2003 Ryan
6,596,814 B2 7/2003 Kim et al.
6,612,099 B2 9/2003 Stravitz
D482,109 S 11/2003 Woods
D482,110 S 11/2003 Laferriere et al.
D482,111 S 11/2003 Laferriere et al.
6,647,697 B1 11/2003 Zarrow et al.
6,656,514 B1 12/2003 Tubbs
6,719,194 B2 4/2004 Richards
6,722,107 B2 4/2004 Morand
D491,257 S 6/2004 Picken, Jr.
D492,018 S 6/2004 Schroder
6,804,930 B2 10/2004 Stravitz
6,817,164 B2 11/2004 Maufette et al.
D500,590 S 1/2005 Sachen
D501,602 S 2/2005 Karlsson et al.
6,851,251 B2 2/2005 Stravitz
6,894,085 B2 5/2005 Beaverson et al.
6,901,974 B2 6/2005 Chomik et al.
6,914,091 B2 7/2005 Donald et al.
6,921,581 B2 7/2005 Van Gelder et al.
6,925,781 B1 8/2005 Knuth et al.
6,931,684 B1 8/2005 Henegar
6,941,733 B2 9/2005 Chomik et al.
6,956,088 B2 10/2005 Farley et al.
6,974,029 B2 12/2005 Morand et al.
D515,683 S 2/2006 LaBlaine
6,993,891 B2 2/2006 Richardson et al.
6,994,247 B2 2/2006 Richards
7,004,632 B2 2/2006 Hamilton et al.
D517,673 S 3/2006 Yamamoto et al.
D523,632 S 6/2006 Handley
7,073,311 B2 7/2006 Chomik et al.
7,086,569 B2 8/2006 Stravitz
7,100,767 B2 9/2006 Chomik et al.
7,114,314 B2 10/2006 Stravitz
7,114,534 B2 10/2006 Chomik et al.
7,146,785 B2 12/2006 Stravitz
7,168,591 B1 1/2007 Miller
7,175,918 B2 2/2007 Saraf et al.
7,178,314 B2 2/2007 Chomik et al.
7,241,493 B2 7/2007 Zhou
D550,345 S 9/2007 Weggelaar
D551,333 S 9/2007 Wu
7,279,198 B1 10/2007 Knauf
7,288,593 B2 10/2007 Yang et al.
7,300,207 B2 11/2007 Linneweil
7,303,075 B2 12/2007 Herbert et al.
7,316,100 B2 1/2008 Stravitz et al.
7,328,547 B2 2/2008 Mehta et al.
7,347,624 B2 3/2008 Savicki, Sr. et al.
D565,715 S 4/2008 Wu
7,350,663 B2 4/2008 Chomik et al.
7,377,203 B2 5/2008 Chomik
7,395,646 B2 7/2008 Salman et al.
7,434,377 B2 10/2008 Stravitz et al.
7,459,191 B2 12/2008 Sleight et al.
D585,129 S 1/2009 Huang
7,490,734 B2 2/2009 Carr
7,500,339 B2 3/2009 Knuth et al.
7,503,152 B2 * 3/2009 Stravitz ..... B65B 9/15 53/211
7,503,159 B2 3/2009 Stravilz et al.
D591,415 S 4/2009 Wu
D591,509 S 5/2009 Lown et al.
7,607,911 B2 10/2009 Sperry et al.
7,629,036 B2 12/2009 Chomik et al.
D609,008 S 2/2010 Diamant
D614,897 S 5/2010 Morand et al.
D615,786 S 5/2010 Morand et al.
7,707,808 B2 5/2010 Chomik et al.
7,712,285 B2 * 5/2010 Stravitz ..... B65F 1/12 200/61.62
7,743,588 B2 6/2010 Webb et al.
7,757,467 B2 7/2010 Chomik et al.
7,958,704 B2 1/2011 Stravitz et al.
7,931,150 B2 4/2011 Morand
D639,002 S * 5/2011 Dunn ..... D32/37
D639,003 S * 5/2011 Dunn ..... D32/37
D639,004 S 5/2011 Dunn et al.
7,950,246 B1 5/2011 Mayer et al.
7,963,414 B1 6/2011 Stravitz
8,091,325 B2 1/2012 Stravitz et al.
8,127,519 B2 3/2012 Stravitz
8,215,089 B2 7/2012 Stravitz
8,235,237 B1 8/2012 Stravitz
8,266,870 B1 * 9/2012 Stravitz ..... B65B 51/00 53/370
8,440,316 B2 5/2013 Chomik et al.
8,484,936 B2 7/2013 Tannock
D695,541 S * 12/2013 Dunn ..... B65F 1/062 D6/515
8,899,420 B2 12/2014 Morand
8,910,821 B1 * 12/2014 Stravitz ..... B65F 1/06 220/495.04
9,056,716 B1 * 6/2015 Stravitz ..... B65F 1/06
D777,394 S * 1/2017 Stravitz ..... D34/10
9,555,962 B1 * 1/2017 Stravitz ..... B65F 1/06
9,573,757 B1 * 2/2017 Stravitz ..... B65F 1/06
D795,606 S * 8/2017 Cudworth ..... D6/515
9,834,376 B1 * 12/2017 Stravitz ..... B65F 1/1415
2001/0037627 A1 11/2001 Hausslein
2002/0162304 A1 11/2002 Stravitz
2003/0078552 A1 4/2003 Tepper et al.
2003/0121923 A1 7/2003 Morand et al.
2003/0190097 A1 10/2003 Hajianpour
2004/0020175 A1 2/2004 Stravitz
2004/0083681 A1 5/2004 Stravilz
2004/0141663 A1 * 7/2004 Gillis ..... A61J 19/00 383/42
2004/0191438 A1 9/2004 Cosentino et al.
2004/0217122 A1 11/2004 Trinko et al.
2005/0016890 A1 * 1/2005 Tannock ..... B65B 9/18 206/497
2005/0033259 A1 2/2005 Stravitz
2005/0044819 A1 3/2005 Richard et al.
2005/0079372 A1 4/2005 Schmal et al.
2005/0131368 A2 6/2005 Snell
2005/0183400 A1 8/2005 Stravitz et al.
2005/0188661 A1 9/2005 Stravitz et al.
2005/0193691 A1 9/2005 Stravitz et al.

(56) References Cited

U.S. PATENT DOCUMENTS

| | | | | |
|---|---|---|---|---|
| 2005/0193692 | A1 | 9/2005 | Stravilz et al. | |
| 2005/0217214 | A1 | 10/2005 | Richardson et al. | |
| 2005/0228354 | A1 | 10/2005 | Scholer | |
| 2005/0274093 | A1 | 12/2005 | Stravitz et al. | |
| 2006/0013512 | A1 | 1/2006 | Shaw | |
| 2006/0021301 | A1 | 2/2006 | Stravitz et al. | |
| 2006/0130438 | A1 | 6/2006 | Stravitz et al. | |
| 2006/0130439 | A1* | 6/2006 | Stravitz | B65B 9/15 53/567 |
| 2006/0237461 | A1 | 10/2006 | Chomik et al. | |
| 2006/0249418 | A1 | 11/2006 | Chomik et al. | |
| 2006/0251842 | A1 | 11/2006 | Chomik et al. | |
| 2007/0031068 | A1* | 2/2007 | Gillis | A61J 19/00 383/33 |
| 2007/0045324 | A1 | 3/2007 | Mitchell et al. | |
| 2007/0053616 | A1 | 3/2007 | Plouff | |
| 2007/0157581 | A1 | 7/2007 | Stravitz et al. | |
| 2007/0175182 | A1 | 8/2007 | Stravitz et al. | |
| 2007/0180798 | A1 | 8/2007 | Stravitz et al. | |
| 2007/0189643 | A1 | 8/2007 | Tresenfeld | |
| 2007/0246465 | A1* | 10/2007 | Stravitz | B65B 67/1277 220/200 |
| 2008/0019618 | A1* | 1/2008 | Dayton | B65D 33/25 383/61.1 |
| 2008/0078762 | A1 | 4/2008 | Iyer | |
| 2008/0134644 | A1 | 6/2008 | Knuth et al. | |
| 2008/0164257 | A1* | 7/2008 | Boll | B65F 1/08 220/264 |
| 2008/0179330 | A1 | 7/2008 | Brooks et al. | |
| 2008/0199643 | A1 | 8/2008 | Withers | |
| 2008/0247679 | A1 | 10/2008 | Dayton et al. | |
| 2008/0272140 | A1 | 11/2008 | Mowers et al. | |
| 2008/0310772 | A1* | 12/2008 | Dayton | A41D 19/0075 383/61.1 |
| 2009/0065521 | A1 | 3/2009 | Amundson et al. | |
| 2009/0100806 | A1 | 4/2009 | Morand | |
| 2010/0005759 | A1 | 1/2010 | Stravitz | |
| 2010/0005762 | A1 | 1/2010 | Stravitz | |
| 2010/0006712 | A1 | 1/2010 | Stravitz | |
| 2010/0089926 | A1* | 4/2010 | Lacy | B65F 1/062 220/521 |
| 2011/0000172 | A1 | 1/2011 | Morand | |
| 2011/0099945 | A1* | 5/2011 | Dunn | B65F 1/0006 53/211 |
| 2011/0099950 | A1* | 5/2011 | Dunn | B65F 1/062 53/459 |
| 2011/0099954 | A1* | 5/2011 | Cudworth | B65F 1/062 53/510 |
| 2011/0100995 | A1* | 5/2011 | Dunn | B32B 27/08 220/495.01 |
| 2012/0073250 | A1* | 3/2012 | Cudworth | B65F 1/062 53/545 |
| 2012/0080352 | A1 | 4/2012 | Morand | |
| 2012/0091295 | A1* | 4/2012 | Morand | B65B 67/1222 248/99 |
| 2014/0183193 | A1* | 7/2014 | Hammond | B65F 1/002 220/87.2 |
| 2015/0052858 | A1 | 2/2015 | Morand | |
| 2016/0060025 | A1* | 3/2016 | Dunn | B65F 1/0006 206/409 |
| 2016/0060027 | A1* | 3/2016 | McConnell | B65F 1/06 434/236 |
| 2016/0060028 | A1* | 3/2016 | McConnell | B65F 1/06 434/236 |
| 2016/0060029 | A1* | 3/2016 | McConnell | B65F 1/002 383/34.1 |
| 2016/0083182 | A1* | 3/2016 | Dunn | B65F 1/062 206/409 |
| 2016/0167874 | A1* | 6/2016 | Dunn | B65F 1/062 220/495.05 |
| 2016/0221750 | A1* | 8/2016 | Cavaletti | B65F 1/1415 |
| 2016/0244256 | A1 | 8/2016 | Morand | |
| 2016/0244257 | A1 | 8/2016 | Morand | |
| 2016/0244258 | A1 | 8/2016 | Morand | |

FOREIGN PATENT DOCUMENTS

| | | | |
|---|---|---|---|
| CA | 2686128 | C | 11/2008 |
| CA | 2936420 | A1 | 4/2009 |
| CA | 2387183 | C | 5/2009 |
| CA | 2640384 | C | 9/2014 |
| CA | 2855159 | C | 11/2016 |
| CA | 2936415 | C | 4/2017 |
| CA | 2936421 | C | 4/2017 |
| CA | 2937312 | C | 4/2017 |
| DE | 9319683 | U1 | 6/1994 |
| DE | 202005015117 | | 2/2007 |
| DE | 202005015117 | | 3/2007 |
| EP | 303517 | A1 | 2/1989 |
| EP | 699584 | A2 | 6/1996 |
| EP | 0913344 | | 5/1999 |
| EP | 2045197 | A1 | 4/2009 |
| EP | 2818430 | A1 | 12/2014 |
| GB | 399031 | | 9/1933 |
| GB | 772538 | | 4/1957 |
| GB | 2206094 | | 12/1988 |
| GB | 2221889 | A | 2/1990 |
| JP | 5429272 | | 3/1979 |
| JP | 63123701 | A | 5/1988 |
| JP | 2002226003 | | 6/2002 |
| JP | 2004175508 | A | 6/2004 |
| JP | 3134078 | | 7/2007 |
| JP | 3134078 | U9 | 7/2007 |
| JP | 5331205 | | 10/2013 |
| WO | 199817536 | A1 | 4/1998 |
| WO | 99/39675 | A1 | 8/1999 |
| WO | 0220354 | A | 3/2002 |
| WO | 200220354 | A1 | 3/2002 |
| WO | 02/42364 | A2 | 5/2002 |
| WO | 02/051788 | A1 | 7/2002 |
| WO | 2003059748 | A2 | 7/2003 |
| WO | 2003068635 | A1 | 8/2003 |
| WO | 2003-089312 | | 10/2003 |
| WO | 2005/042381 | | 5/2005 |
| WO | 2005/042381 | A2 | 5/2005 |
| WO | 2005042381 | A3 | 5/2005 |
| WO | 2007/130889 | A2 | 11/2007 |
| WO | 2007130889 | A2 | 11/2007 |
| WO | 2008/059282 | | 5/2008 |
| WO | 2009007723 | A | 1/2009 |

OTHER PUBLICATIONS

PCT/US2010/053768, Preliminary Search Report and Written Opinion (8 Pages) dated May 10, 2012.

International Search Report for International Application No. PCT/US2010/053768.

Copending U.S. Appl. No. 12/172,715, filed Jul. 14, 2008 entitled "Waste Disposal Devices".

Copending U.S. Appl. No. 12/172,758, filed Jul. 14, 2008 entitled "Tubing Assembly for Waste Disposal Devices".

Copending U.S. Appl. No. 12/172,793, filed Jul. 14, 2008 entitled "Waste Disposal Devices".

International Search Report, dated Mar. 2, 2016, pp. 1-5.

Written Opinion of International Search Authority, dated Mar. 2, 2016, pp. 1-11.

* cited by examiner

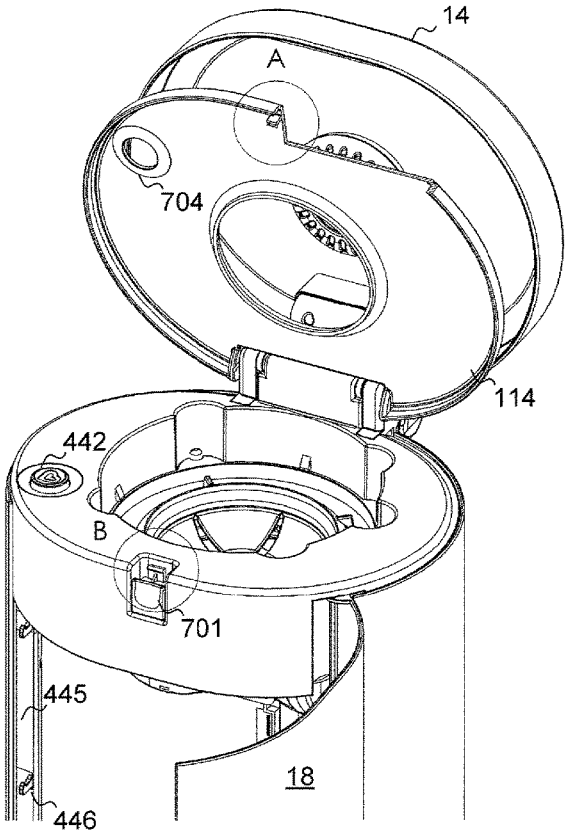
FIG. 50
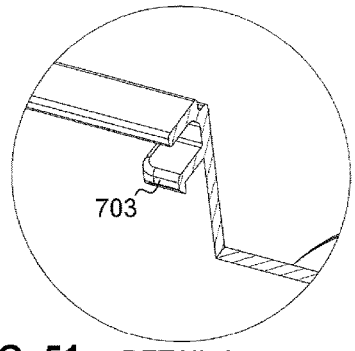
FIG. 51 DETAIL A
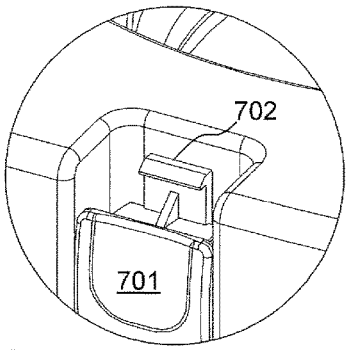
FIG. 52 DETAIL B

CONTAINER FOR RECEIVING MULTIPLE FLEXIBLE BAG ASSEMBLIES

CROSS REFERENCE TO RELATED APPLICATIONS

This application claims priority to U.S. Provisional Patent Application Ser. No. 62/090,558, filed Dec. 11, 2014, the contents of which are hereby incorporated by reference herein in their entirety into this disclosure.

TECHNICAL FIELD

The subject disclosure relates to a waste disposal and system. More specifically, to a multi-component container system, such as a pail assembly, being configured for use with various bag assemblies, including a single use bag and/or a cassette having a resilient flexible tubing packed therein.

BRIEF DESCRIPTION OF THE DRAWINGS

Various exemplary embodiments of this disclosure will be described in detail, wherein like reference numerals refer to identical or similar components or steps, with reference to the following figures, wherein:

FIGS. 50-52 show a front perspective view and detailed views, of an exemplary latching mechanism for the internal lid of the pail assembly.

DETAILED DESCRIPTION

Particular embodiments of the present invention will now be described in greater detail with reference to the figures.

Figure 2:
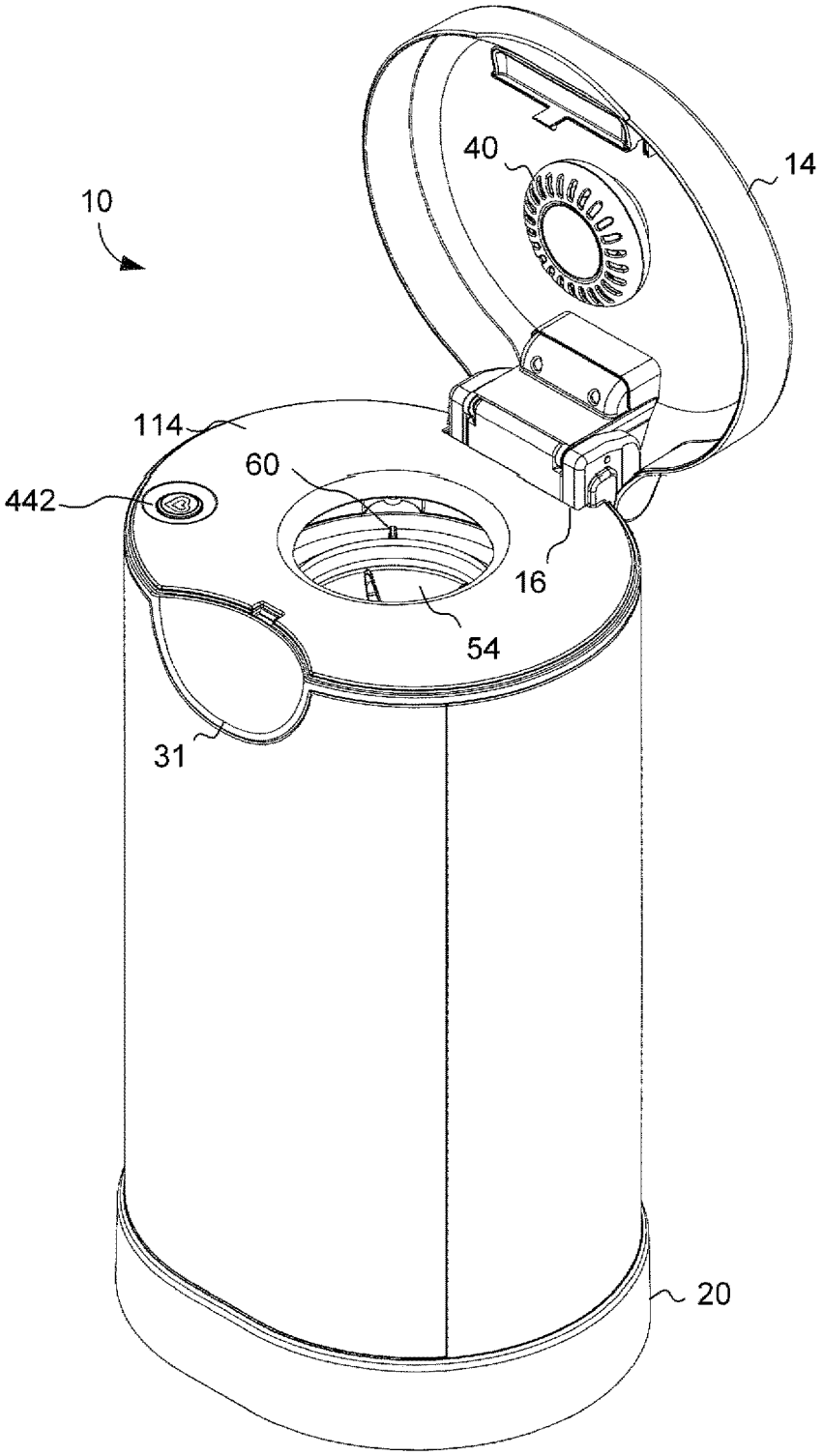
FIG. 2 depicts a top perspective view of the pail assembly with the internal lid closed.
Figure 3:
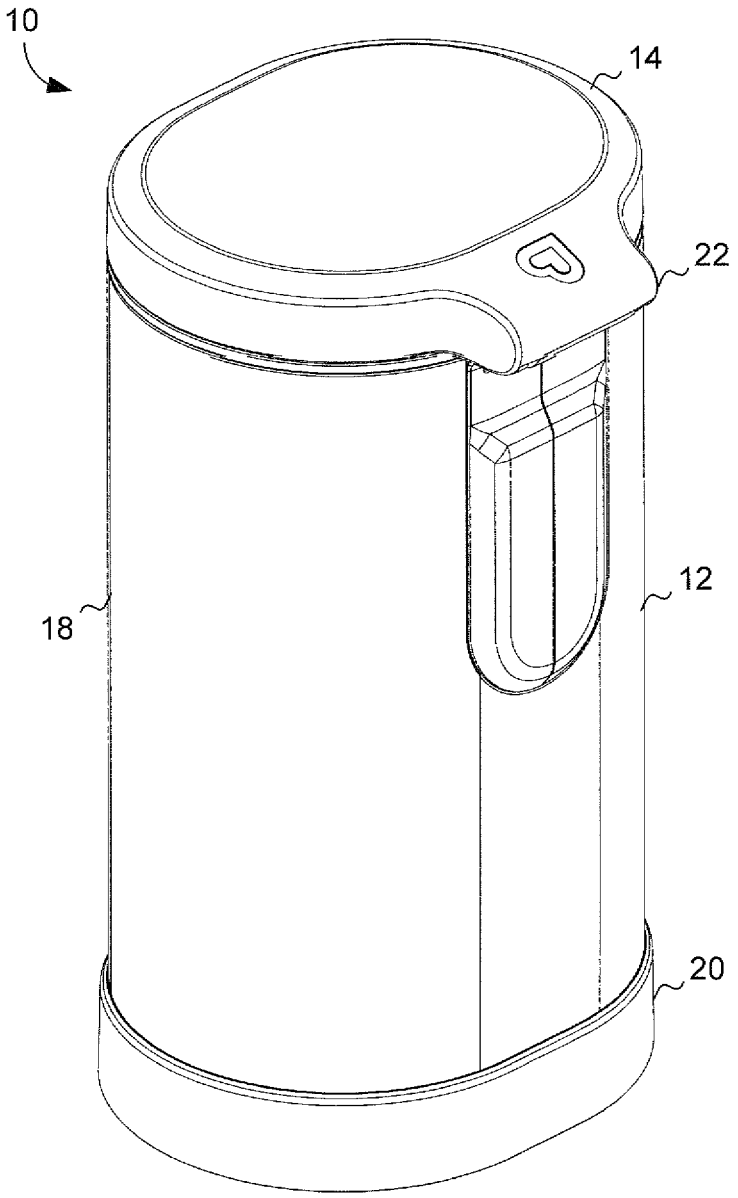
FIG. 3 shows a top perspective view of the pail assembly with the lid closed.
Figure 4:
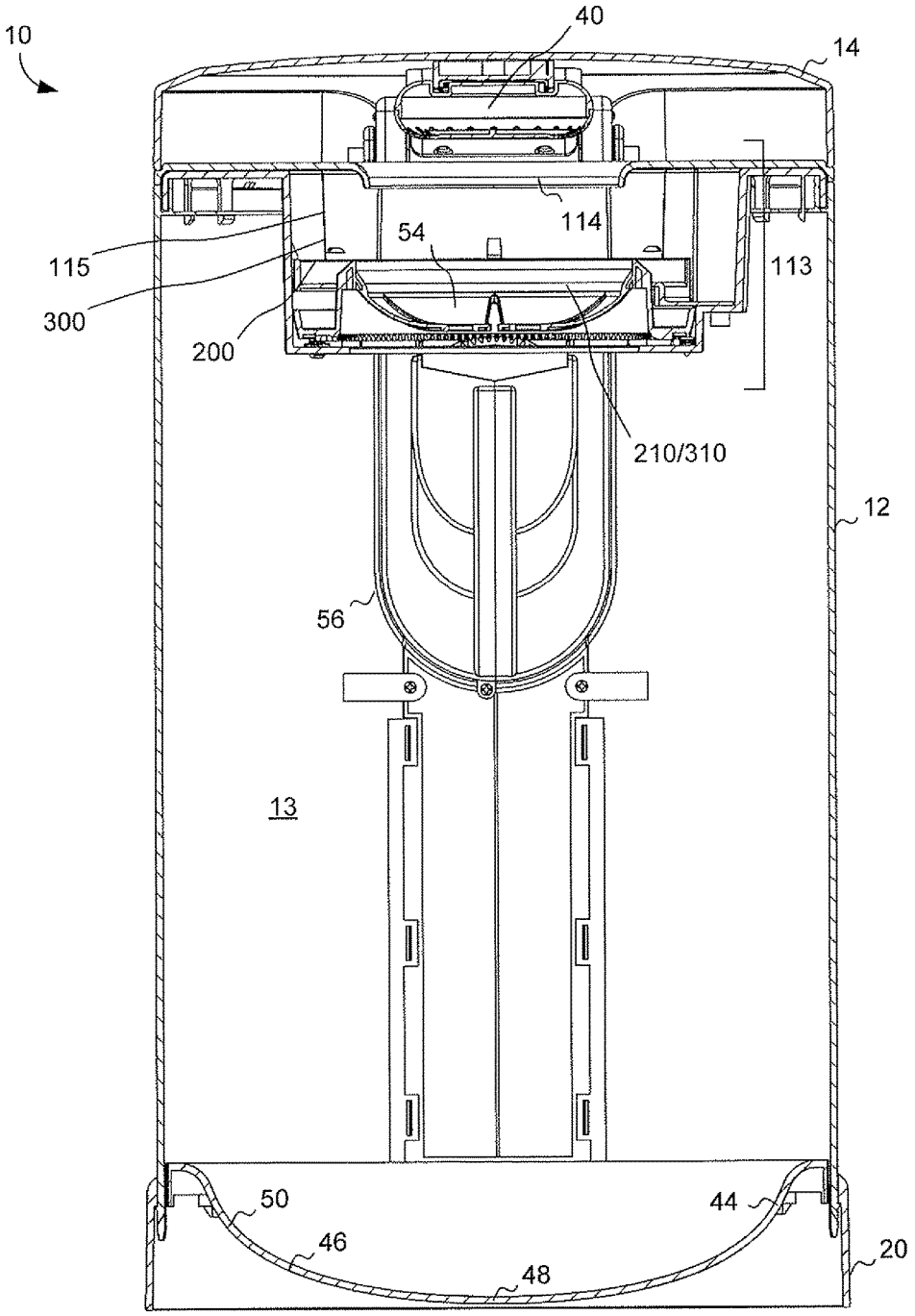
FIG. 4 illustrates a cross section view of the pail assembly.

FIGS. 1-4 illustrate a container, such as a diaper pail assembly or system, 10 adapted to receive multiple flexible bag assemblies. The diaper pail assembly or system 10 includes a housing 12 enclosed by a lid member 14. As shown in FIG. 4, a waste chamber 113 is positioned within the housing 12 above an interior storage space 13 and is configured to receive an article of waste within a flexible bag assembly 210/310.

Figure 1A:
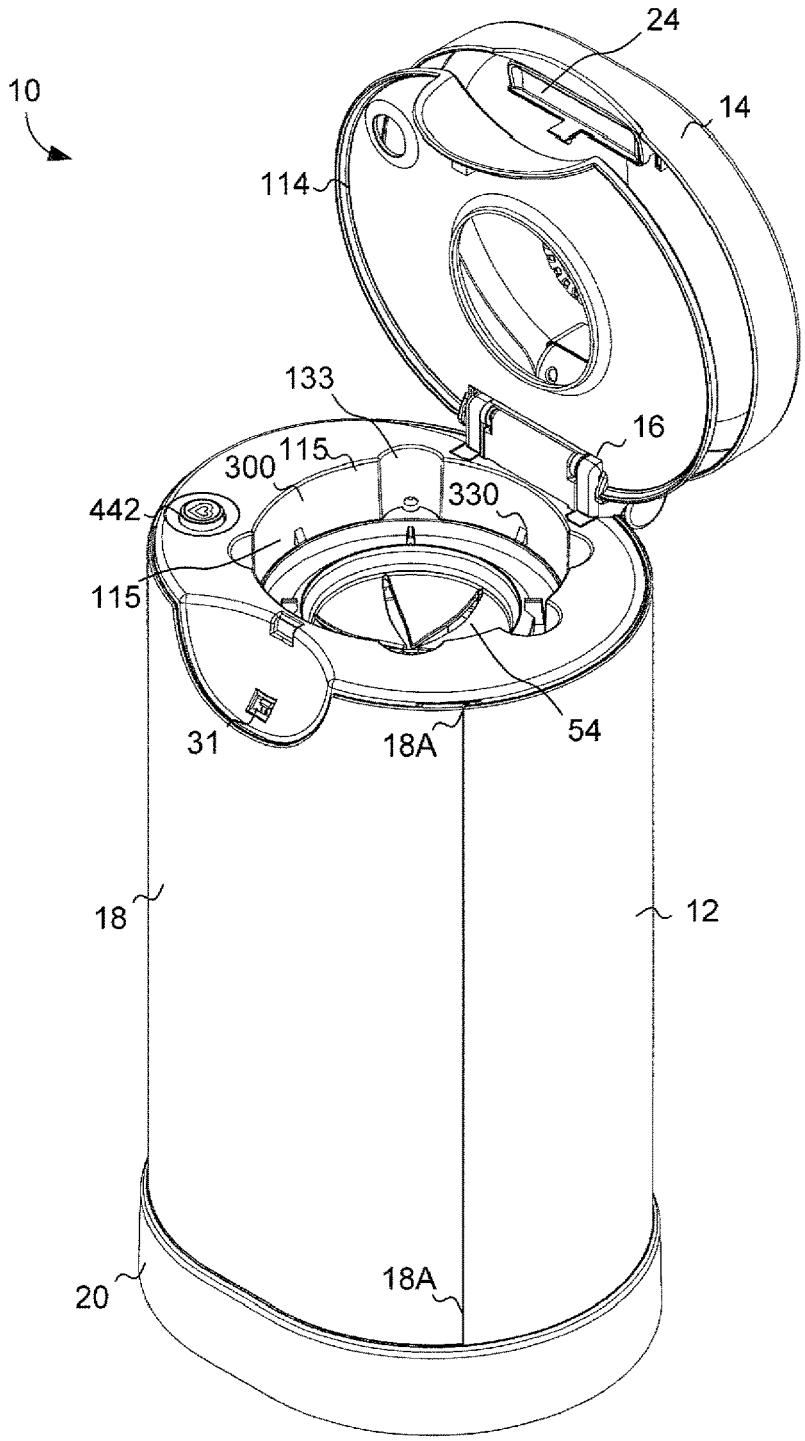
FIGS. 1A-1B illustrate top and detailed perspective views, respectively, of a pail assembly according to the subject disclosure.
Figure 1B:
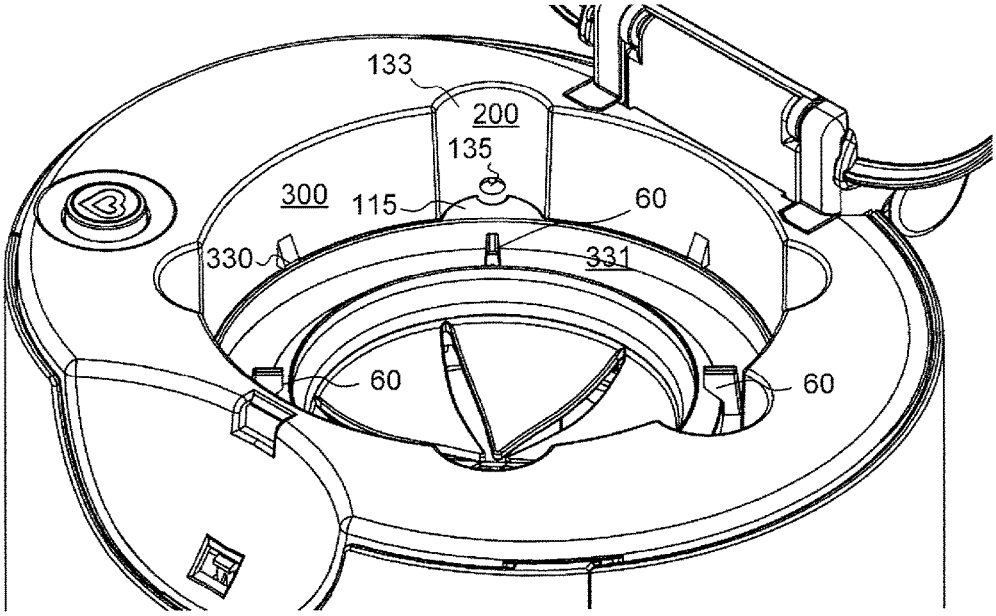

As shown in FIG. 1B, a first support structure 200 and a second support structure 300 accommodate various style of bag inserts, whether they are single use bags or a cassette having a roll of tubing, as will be described in more detail below. A first support structure 200 includes recesses 133 having a semi-circular shape are used to accommodate single use bags by receiving their external tabs, and securing those tabs in place by use of tab clip 135. A second support structure 300 includes key projections, protruding keys, or mating keys 60 that project upward a predetermined distance so that they mate with apertures at a bottom portion of an insertable cassette. A circular bottom receiving plate 331 is held into location by tabs 330 located on the interior wall of annular cylindrical recess 115 and is used to serve as the base for all types of receiving bag assemblies. The mechanisms for these exemplary bag assemblies will be described in more detail below.

The lid member 14 is connected to the housing 12 by a hinge mechanism 16 so that the lid member 14 can be moved by a user, such as a parent or caregiver, between an open position that is shown in FIGS. 1-2 and a closed position that is shown in FIG. 3.

Figure 18:
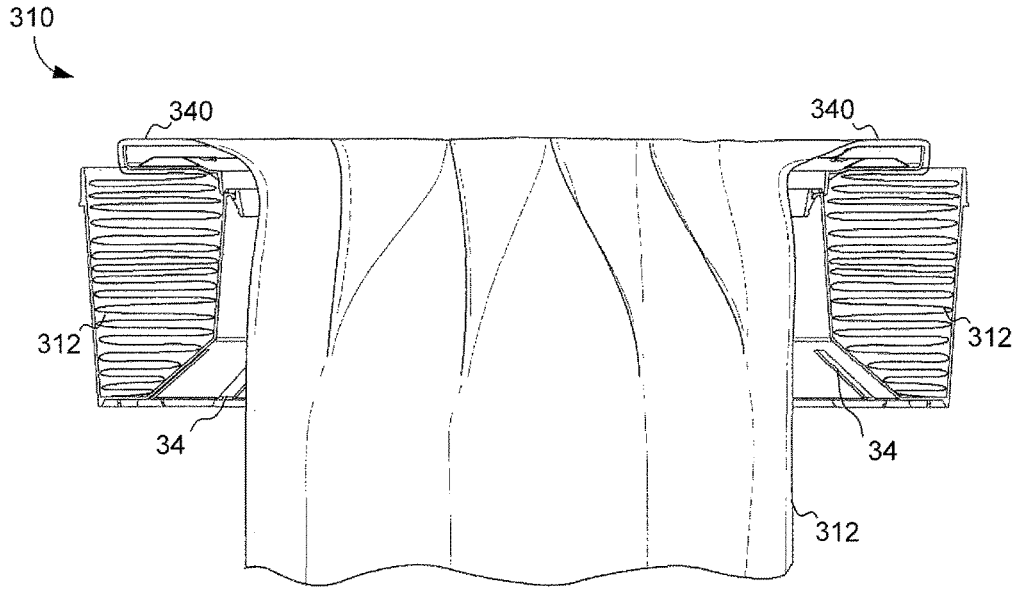

The flexible bag assembly may come in various embodiments. In a first embodiment, the flexible bag assembly may be embodied as a flexible bag frame 214, such as a single use bag shown in FIGS. 9 and 14 and described in more detail below. In a second embodiment, the flexible bag assembly 310 may be embodied as a length of a packed flexible tubing 312 drawn from within a cassette 314, such as the cassette 314 and tubing 312 as shown in FIGS. 10 and 18 and described in more detail below.

The waste chamber 113 shown in FIG. 4 is constructed to include a first support structure 200 to secure the flexible bag 212. The waste chamber 113 is further constructed to include a second support structure 300 to secure and support a cassette 314 from which the flexible tubing 312 is drawn from the cassette 314. The waste chamber 113 is resilient enough to accommodate various designs of bag assemblies and bag assemblies may be designed to accommodate the accommodating structure of waste chamber 113.

Figure 14:
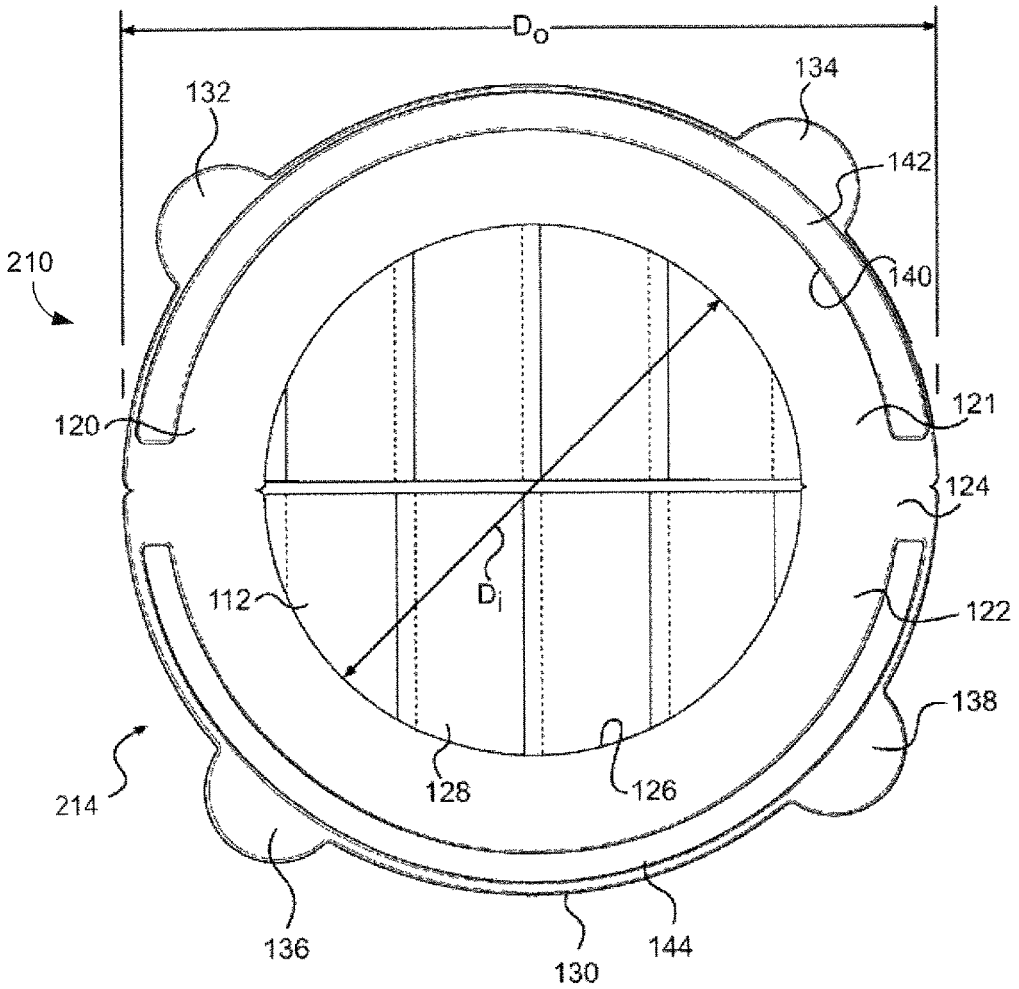
FIG. 14 depicts a top view of the frame structure of the flexible bag used in the pail assembly.

A first support structure 200 is configured to receive the flexible bag assembly being constructed as a single-use bag 212 of a flexible material 212 attached to a frame 214 such as shown in FIG. 14. The frame 214 may be releasably mounted to the first support structure 200 in the housing 12. In position, the first support structure 200 may be constructed to prevent the frame 214 of the flexible bag 212 from rotating inside of the housing 12. The single use bag is described in further detail as FIG. 21 in U.S. Pat. No. 8,833,592, which is incorporated by reference herein in its entirety into this disclosure. For sake of brevity, the physical description of the single use bag will not be repeated again here.

Figure 12A:
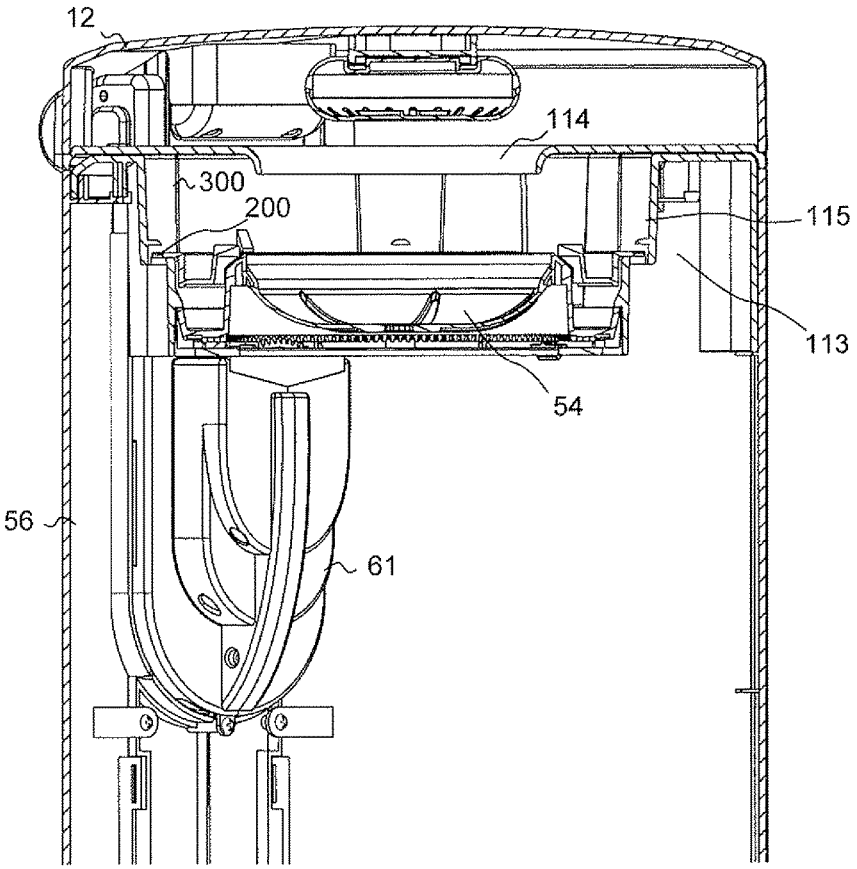
FIGS. 12A and 12B show enlarged cross section and detailed views, respectively, of the first and second support structure in the pail assembly.
Figure 12B:
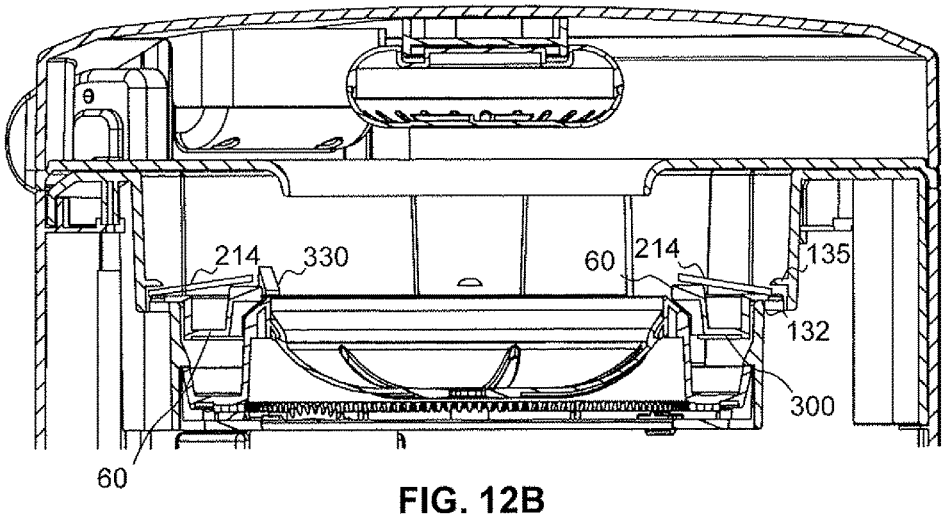
Figure 13:
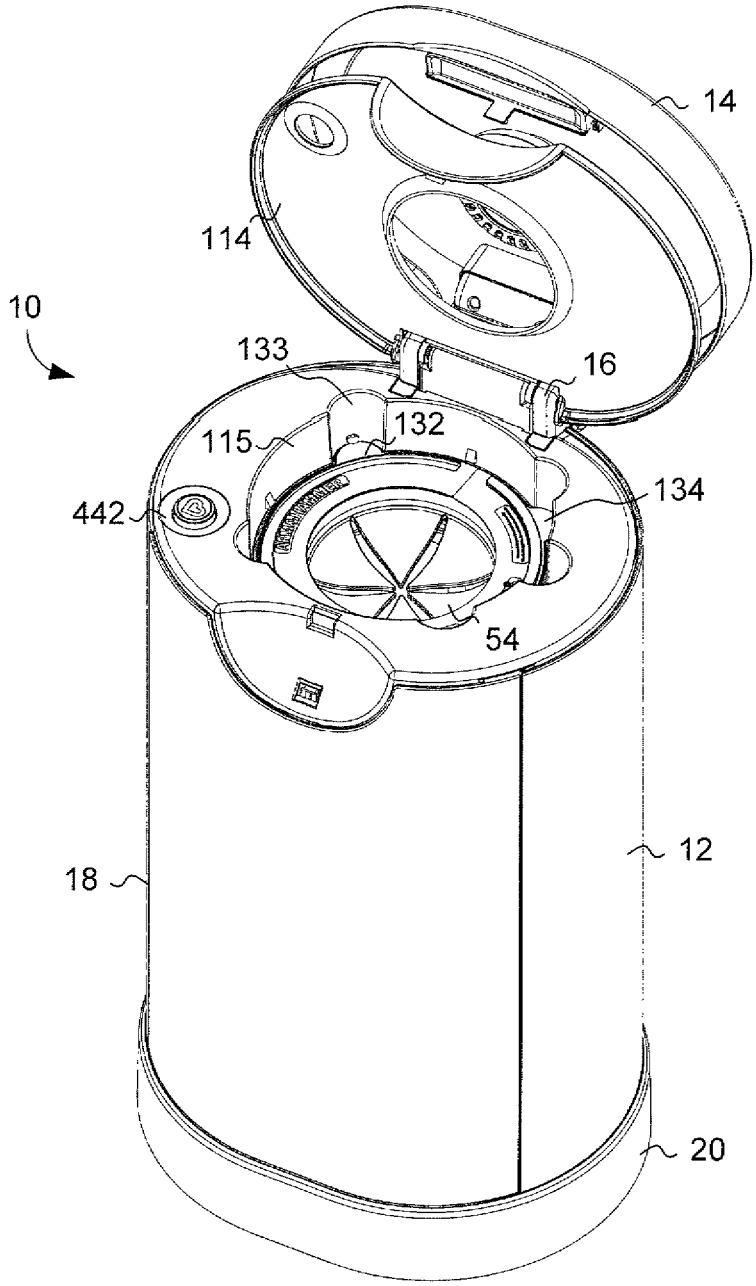
FIG. 13 illustrates a top perspective view of the flexible bag used in the first support structure of the pail assembly.

As shown in FIGS. 12A and B, when the single use bag assembly 210 is interested into the system, an outer edge of the single use bag frame 214 is tucked underneath tabs clips 135 positioned around the annular ring of the waste chamber 113. Only the outer edge of the single use bag frame 214 of the single use bag assembly 210 is shown in FIG. 12 B without further detail of the structure and bag of the single use bag assembly 210 for sake of simplicity in order to show the positioning of the assembly 210 within the tab clips 135. Key projections 60 primarily used in the second support structure 300 serve to lift the outer edge 214 of the single bag assembly 210 such that the top of the key projections 60 act as the seat for bag assembly 210. The frame 214 is secured between in the recess formed underneath tab clips 135. This positioning gives the single use bag assembly 210 a more secure position within the waste chamber 113 and ensures that the bag assembly 210 remains firmly in place whenever further waste is deposited into the bag assembly.

A second support structure 300 is configured to receive the cassette 314 including the packed length of a flexible tubing 312 as shown in FIG. 10. As shown in FIGS. 10 and 18, the flexible tubing 312 is drawn from within the cassette 314 and fed out of the cassette 314 and through the waste chamber 113 and into the storage space 13 while in use. A knot (not shown) may be tied at the lower end of the flexible tubing 312 to construct a closed lower end bag enclosure.

An internal lid 114 is provided between the lid 14 and the housing 12 that opens and closes over the waste chamber 113 as shown in FIGS. 1-2. The internal lid 114 may also utilize the hinge mechanism 16 used to secure the lid member 14 to the housing 12. The internal lid 114 is provided to prevent the flexible tubing 312 of the cassette 314 from being drawn outward from within the cassette 314 and feeding more tubing 312 when an article of waste is pushed into the flexible tubing 312 within the waste chamber 113.

Figure 19A:
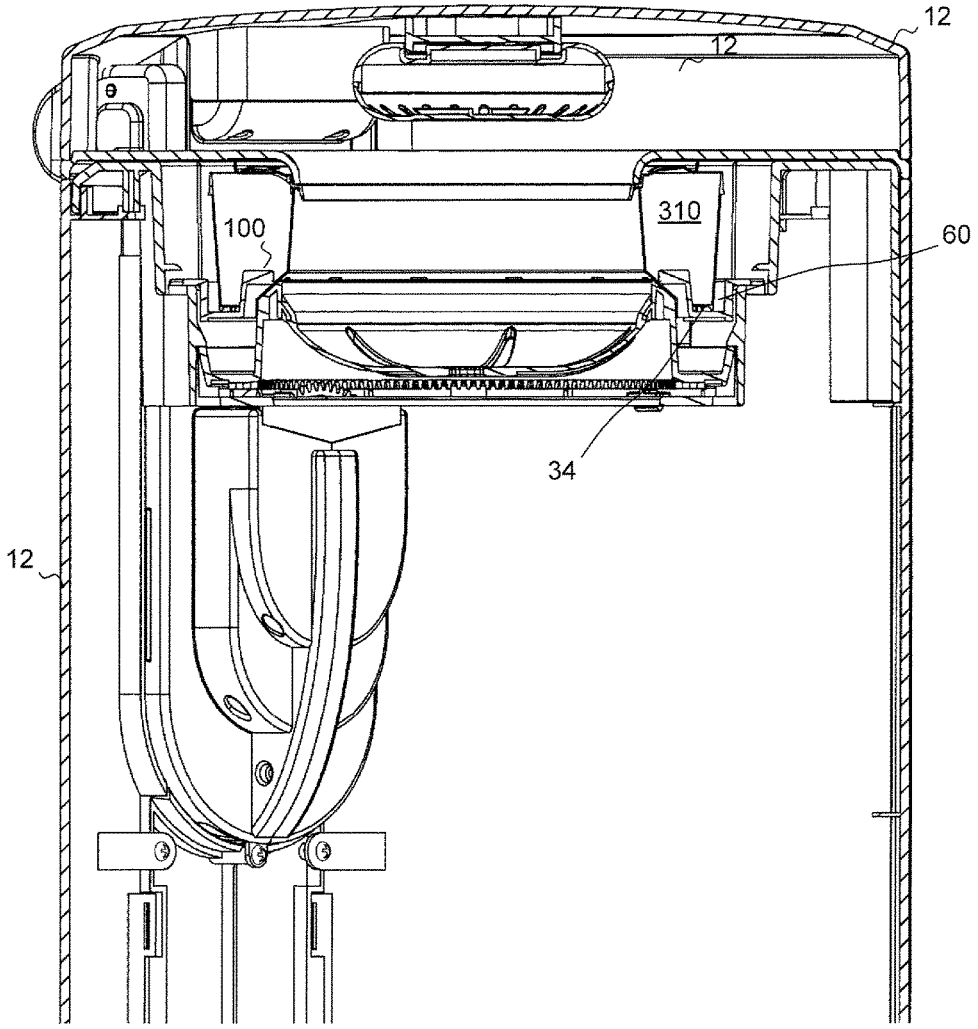
FIGS. 19A-19B show cross section and detailed views, respectively, of the cassette used in the second support structure of the pail assembly.
Figure 19B:
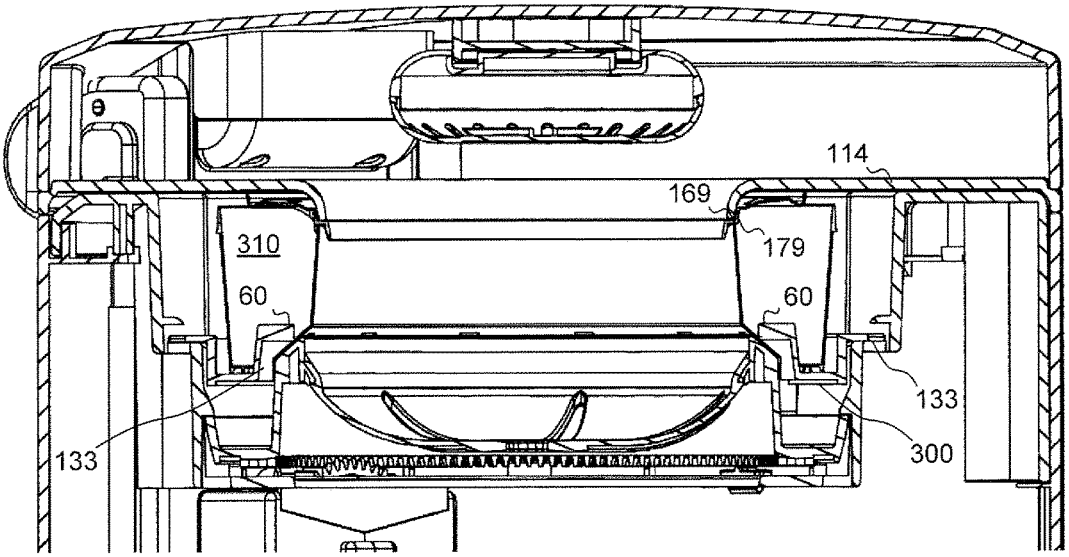

As shown in FIGS. 10, 19A and 19B, the second support structure 300 accommodates the cassette 314 such that the internal apertures 133 on the bottom portion of the cassette 314 receive key projections 60 and essentially lock the cassette 314 in place within the waste chamber 113. Further, when the internal lid 114 is closed, an internal downward projection 169 on the internal lid serves to press down and essentially lock the cassette 314 in position to a degree such that the corresponding interior upper portion 179 of the cassette 314 receives the downward force of the downward projection 169, and secures the cassette in place and presses down on the tube 312 with enough force as to prevent the downward movement of the tube 312 each time further waste is disposed within the container. Upon release of the internal lid 114, the tubing 312 may be pulled out and cut to tie and dispose of the used tubing, as needed. The tubing 312 is then pulled down further to tie a knot and start a subsequent bag 312.

An odor remediating insert 40 may be attached to the lid 14 of the diaper pail assembly 10 as shown in FIG. 2. The odor remediating insert 40 is used to reduce and eliminate foul odors from emanating from within the housing 12 of the diaper pail assembly 10.

A rotatable sealing and gripping mechanism 54 is provided in the waste chamber 113 as shown in FIG. 1. The rotatable sealing and gripping mechanism 54 has a resilient opening in a flexible material is provided through which the flexible bag may pass though a passage therein.

A transmission mechanism 56 is provided and adapted to rotate the rotatable sealing and gripping mechanism 54. In use, the rotatable sealing and gripping mechanism 54 is rotated by the transmission mechanism 56 causing the rotatable sealing and gripping mechanism 54 to twist a portion of the flexible material to seal the passage of the flexible bag closed. As will be shown in a later embodiment, a foot pedal may be configured and adapted to open or close the lid 14, and/or to engage the transmission mechanism 56 to rotate the rotatable member.

As shown in FIG. 4, the housing 12 defines an interior storage space 13 into which various waste packages are placed and stored in use. The housing 12 can be accessed by a parent or a caregiver by opening a door 18. The door 18 is hingedly mounted at hinge 18A with respect to the housing 12.

The diaper pail assembly 10 includes a base portion 20 that is constructed and arranged to support the housing 12 on an underlying horizontal surface such as a floor or a carpet. The base portion 20 encircles the bottom of the housing 12 and provides the bottom surface for the interior storage space 13.

The base portion 20 includes structure 44 for aligning and centering a diaper pail bag within the interior storage space 13 of the housing 12. The aligning and centering structure 44 includes a bottom surface 46 defining a lowermost extent of the interior storage space 13 that includes a central, substantially flat portion 48 and an annular curved portion 50 surrounding the substantially flat portion 48.

A door latching mechanism may be provided on the door 18 for permitting the consumer to open and close the door 18. The door latching mechanism selectively locks the door 18 in a closed position as shown in FIG. 1A.

Figure 5:
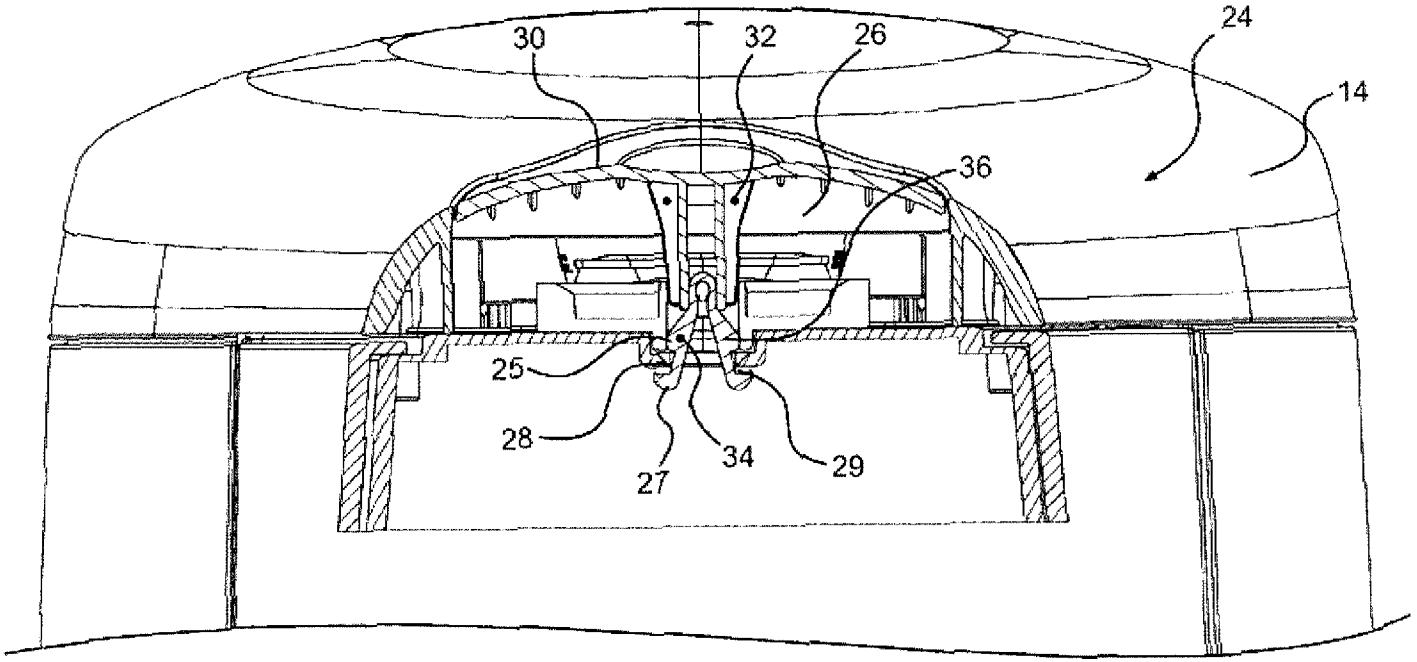
FIG. 5 depicts a cross section of a lid latching mechanism for the lid.

FIG. 5 shows a lid latching mechanism 24 integrated into the lid 14. The lid latching mechanism 24 includes a laterally expandable latch member 26 that is movably mounted on the lid member 14 and a mating recess 28 that is defined in the housing 12. A button or actuating surface 30 is movably mounted on a side of the lid member 14 that is opposite the hinge mechanism 16 so as to permit substantially vertically upward and downward movement with respect to the lid member 14. A slotted plunger member 32 is integral with an underside of the actuating surface 30 and arranged to cam against outer cam surfaces 25 of an opposed pair of pivotally mounted laterally expandable latch members 34, 36 when the actuating surface 30 is depressed by a consumer. Latch members 34, 36 are biased by an internal spring towards the open position that is shown in FIG. 5. The lid latching mechanism 24 is described in further detail as FIG. 4 in U.S. Pat. No. 8,833,592 (hereinafter "'592 patent"), which is incorporated by reference herein in its entirety into this disclosure. For sake of brevity, the physical description of the lid latching mechanism will not be repeated again here.

As shown in FIG. 2, the odor remediating insert 40 is provided on an underside of the lid member 14. The odor remediating insert 40 or a powder dispensing assembly may be incorporated. An exemplary powder dispensing assembly may incorporate the method of operation described in U.S. patent application Ser. No. 12/609,136, filed Oct. 30, 2009, the entire disclosure of which is hereby incorporated by reference as if set forth fully herein.

When a user desires to open the lid member 14 of the diaper pail assembly 10 in order to install a diaper pail bag or dispose an odiferous waste package such as a used disposable diaper, the user may depress an actuator button 30 (such as shown in the '592 patent), which will drive the plunger 32 downwardly, causing the plunger 32 to contact the outer cam surfaces 25 of the respective latch members 34, 36. This will cause the latch members 34, 36 to disengage from the recess 28 and enable the lid member 14 to be lifted upwardly.

As shown in FIG. 1A, an undercut 31 or recess is preferably defined in the housing 12 on an opposite side of housing 12 from the hinge mechanism 16 in order to give the consumer space to be able to exert lifting pressure on a lifting surface of the lid member 14. This will enable a user to easily lift the lid member 14 after the lid latching mechanism 24 has been disengaged.

FIGS. 1-2 depict the internal lid 114 that pivots about the hinge mechanism 16. FIG. 1 depicts the internal lid 114 in an open position and FIG. 2 depicts the internal lid 114 in a closed position. In the closed position, the internal lid 114 is adapted to secure the flexible tubing 312 from extending into the interior storage space 13 within the housing 12. The internal lid 114 does this by pressing down onto the tubing 312 of a flexible diaper pail bag 312 and preventing the flexible tubing 312 from being drawn from within the cassette 314 when a user pushes a waste article into the flexible diaper pail bag 312 as discussed elsewhere.

A rotatable sealing and gripping member 54 is provided in the diaper pail assembly 10. The rotatable sealing and gripping member 54 is constructed and arranged to create a restricted portion within the flexible diaper pail bag 212/312 in order to provide a temporary odor seal. This is accomplished by gripping and twisting the flexible diaper pail bag 212/312 in order to provide a temporary seal, as will be described in greater detail below. Alternatively, the restricted portion 121 as shown in FIG. 9 of the flexible diaper pail bag 212/312 could be created by pinching or folding a portion of the flexible bag 212/312 instead of by twisting it.

A transmission mechanism 56 is provided for causing rotation of the rotatable sealing member 54 for a predetermined rotational distance when the lid member 14 is moved from the open position shown in FIG. 1 to the closed position shown in FIG. 3. The transmission mechanism 56 includes a push rod member or vertical bar 58, visible in FIGS. 1-2 and 5-7, that is caused and constrained to slide linearly downwardly when the lid member 14 is closed and linearly upwardly when it is opened. The transmission mechanism 56 is designed so as not to cause any movement of the rotatable sealing member 54 when the lid member 14 is pivoted upwardly from the closed position to the open position.

Figure 6:
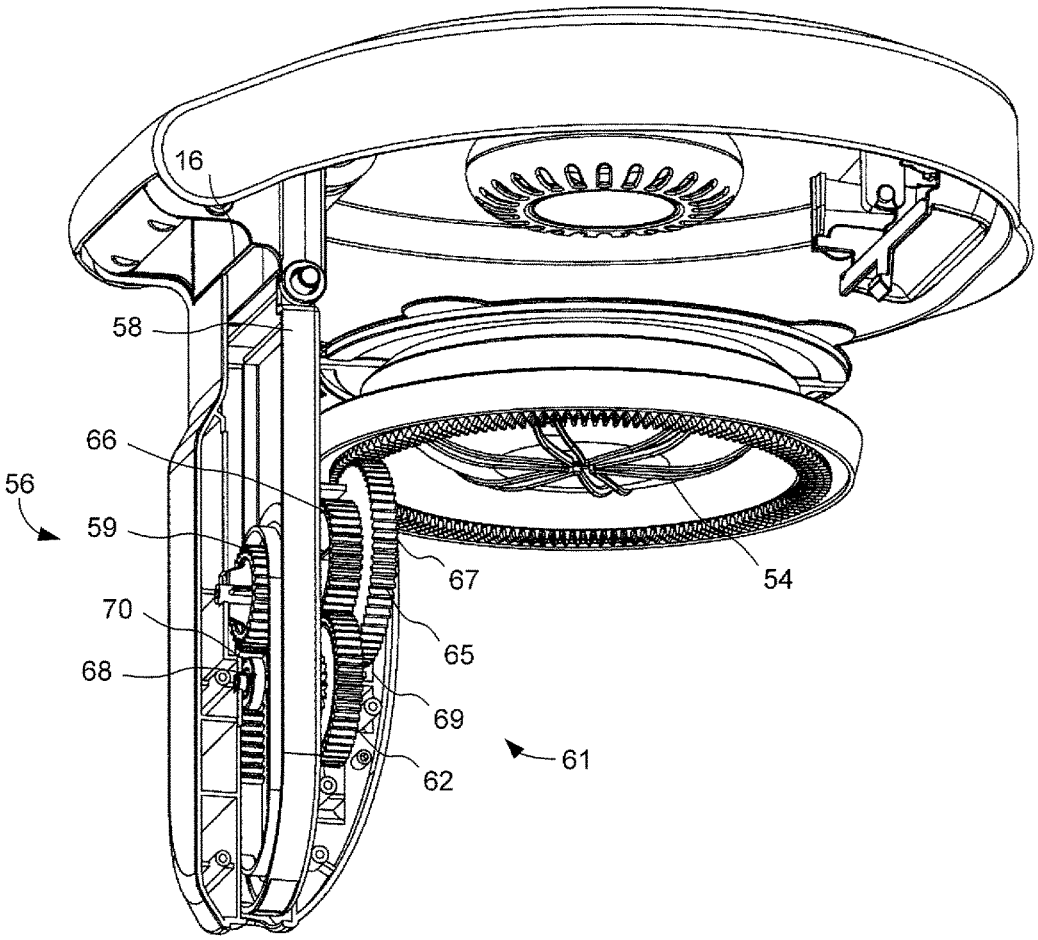
FIG. 6 shows a partial perspective cut away view of the transmission mechanism of the pail assembly.
Figure 7:
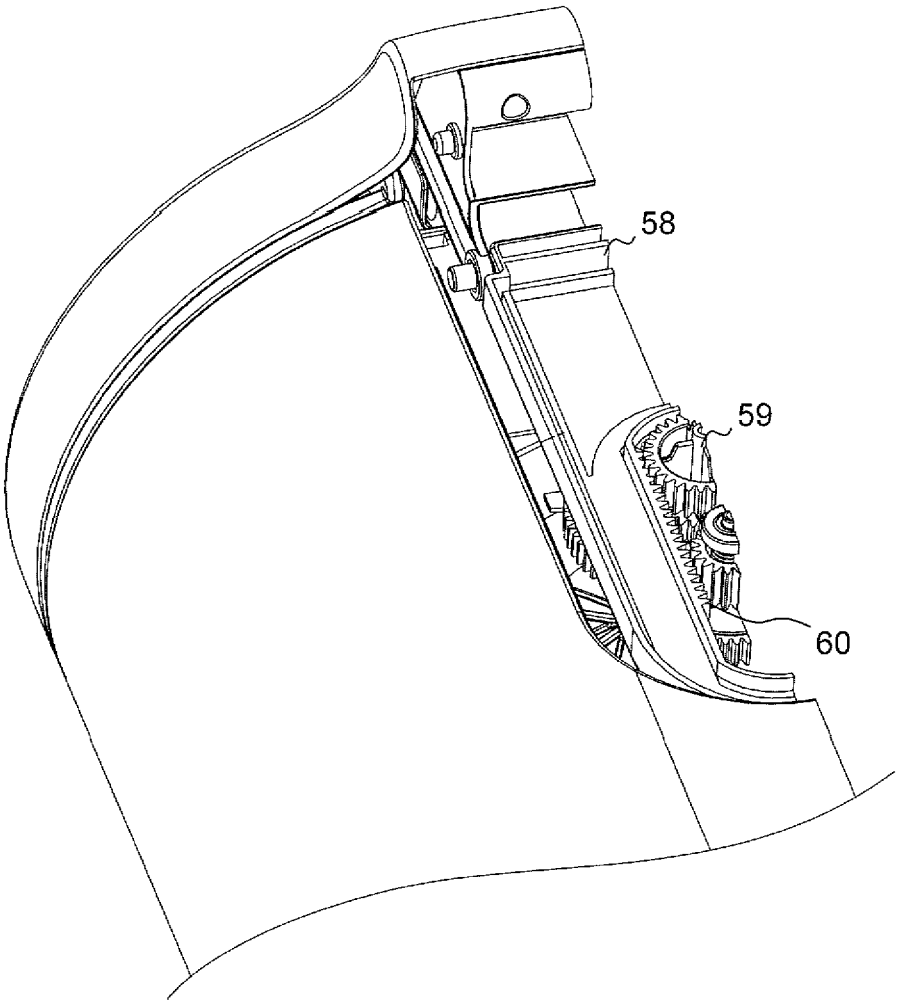
FIG. 7 illustrates another partial perspective cut away view of the transmission mechanism of the pail assembly.
Figure 8:
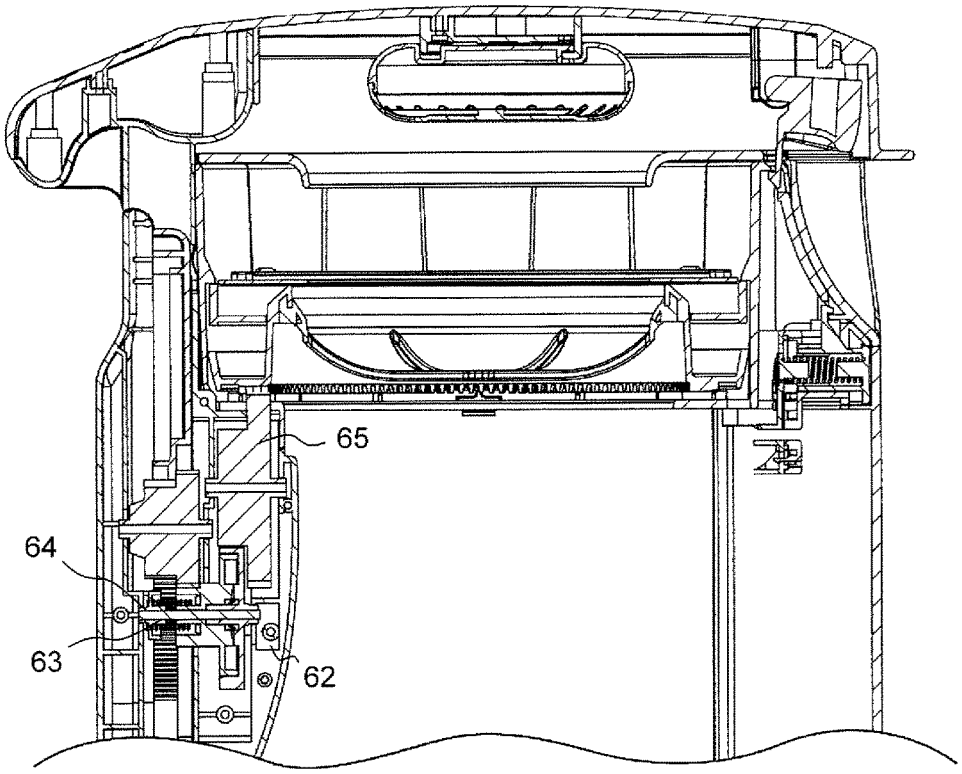
FIG. 8 depicts a partial cross section cut away view of the transmission mechanism of the pail assembly.

The push rod member 58 of the transmission mechanism 56 includes a toothed rack portion 68 as shown in FIG. 6. The push rod member 58 permits vertical movement thereof with respect to the housing 12 by a slotted channel within the internal housing frame 70. A rack engaging gear 59 is mounted for rotation with respect to the internal housing frame 70 in such a manner that it is permitted a limited amount of vertical movement with respect to the internal housing frame 70. Rack engaging gear 59 has teeth that are operatively engaged with corresponding teeth on the toothed rack portion 60 when the rack engaging gear 59 is in its lowermost vertical position. The transmission mechanism 56 is described in further detail as FIG. 12 in the '592 patent, which is incorporated by reference herein in its entirety into this disclosure. For sake of brevity, a detailed physical description of the transmission mechanism will not be repeated again here. However, such a mechanism is used herein for the movement of the sealing member 54.

Figure 9:
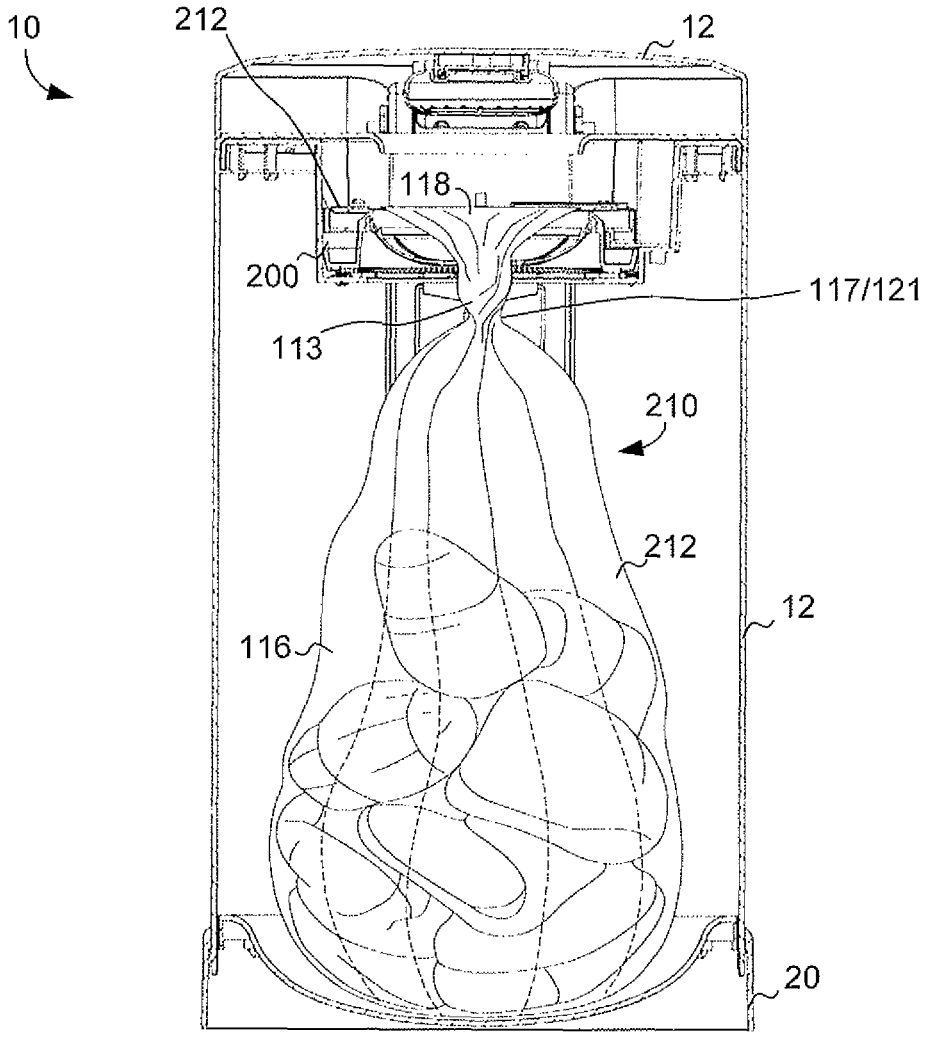
FIG. 9 shows a cross section view of the flexible bag used in the pail assembly.
Figure 10:
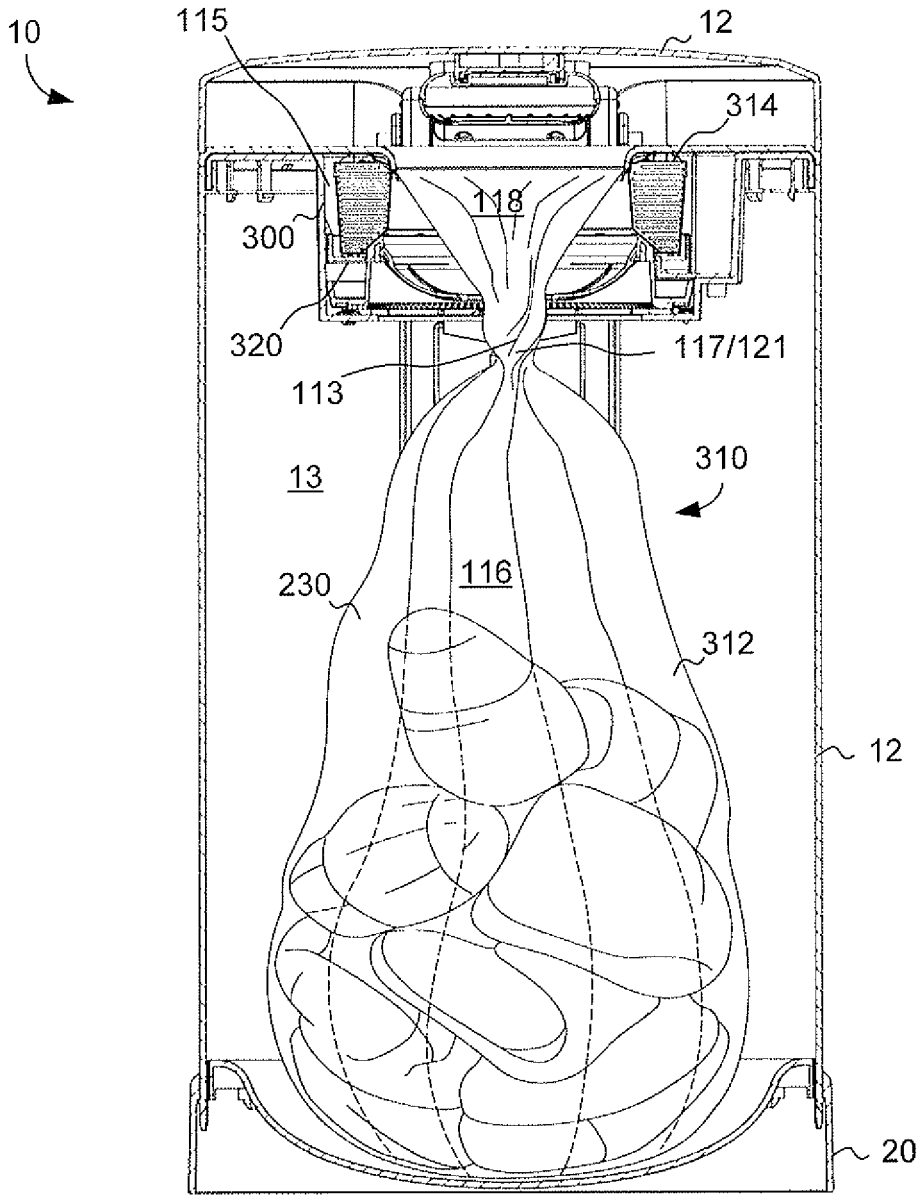
FIG. 10 illustrates a cross section view of the cassette used in the pail assembly.

As shown in FIG. 9, when the lid member 14 is pivoted downwardly by a user from the open position that is shown in FIG. 1 to the closed position that is shown in FIG. 3, the push rod member 58 will be driven downwardly and the rotatable flexible bag retaining and sealing member 54 will be driven by the gear train mechanism 61 to rotate for the predetermined angular distance, thereby creating a twisted portion 121 in an intermediate portion 117 of the flexible bag 212/312 that is between a lower or bottom portion 116 and an upper portion 118. This is diagrammatically shown in FIGS. 9 and 10 for the use with the flexible bag 212 in the first support structure 200, or for use with the flexible tubing 312 drawn from the cassette 314 provided in the second support structure 300.

Figure 11:
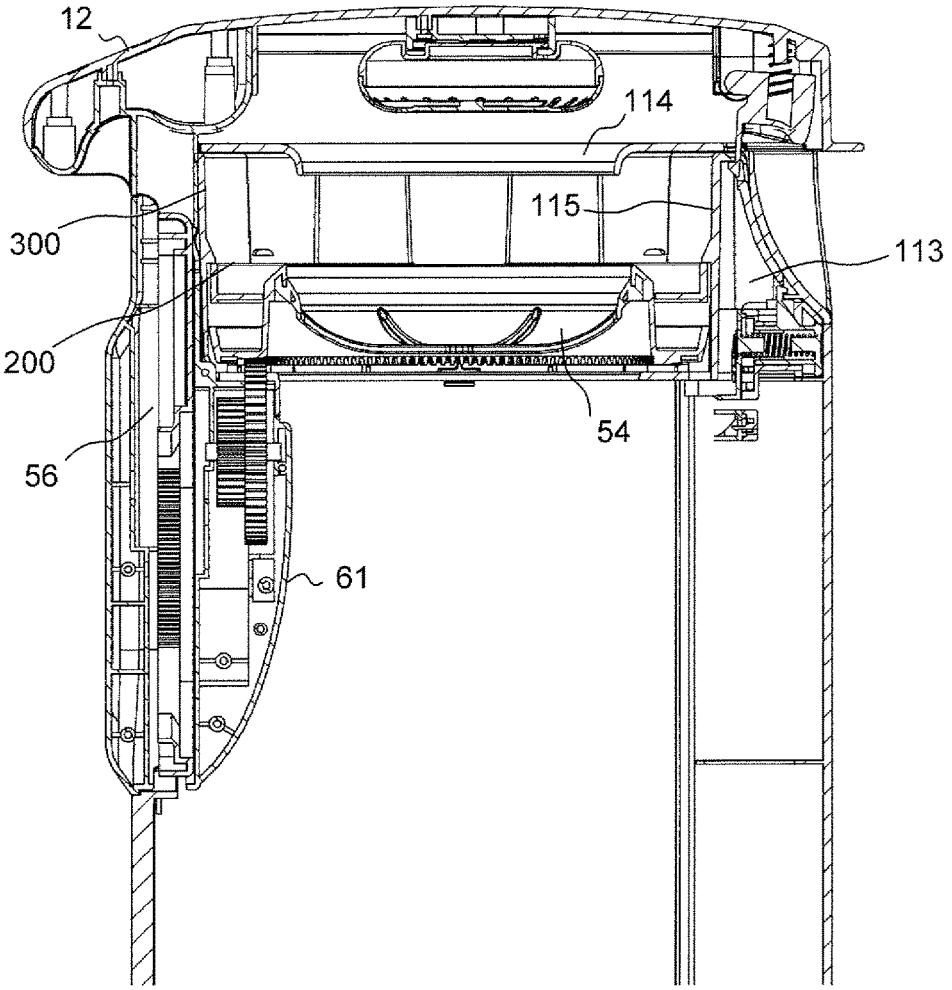
FIG. 11 depicts an enlarged cross section view of the first and second support structure and transmission assembly in the pail assembly.

FIGS. 6, 11 and 12 show the interconnection between the rotatable sealing and gripping member 54, the transmission mechanism 56 and the gear train mechanism 61. The gear train mechanism 61 is operatively interconnected when the push rod member 58 moves downwardly, because the rack engaging gear 59 is in its lowermost vertical position and operatively engaged with the second compound gear 62. However, when the lid member 14 is pivoted upwardly from the closed position to the open position, the rack engaging gear 59 is lifted upwardly out of engagement with the second compound gear 62. Accordingly the gear train mechanism 61 will be disengaged and there will be no rotation of the flexible bag retaining and sealing member 54 when the lid member 14 is opened, which allows the twisted portion 121 of the flexible bag 212/312 to remain closed.

A clutch mechanism is provided in the event that the gear train mechanism becomes jammed. Internal forces within the gear train mechanism will cause the clutch mechanism to permit a relative amount of relative movement between the first gear portion and the second gear portion of the second compound gear. The clutch mechanism may include two relatively slidable components that are biased together by a spring member which is operatively interposed between the second compound gear and the internal housing frame.

The diaper pail assembly 10 is versatile in that various flexible bag assemblies 210, 310, etc. may be used therein. That is, at least shown herein, a single-use flexible bag 212 may be used in combination with the first support structure 200 as shown in FIG. 9. Alternatively, a cassette 314 including a length of flexible tubing 312 may be used in combination with the second support structure 300 as shown in FIG. 10.

The first support structure 200 is constructed within the waste chamber 113 as shown in FIGS. 1, 9 and 13-14. Within the waste chamber 113, a cylindrical recess 115 is provided within the housing 12 to define an inner housing into which the flexible bag 212 or the cassette 314 may be disposed. The cylindrical recess 115 includes a plurality of recesses 133 into which radially outwardly extending projections 132, 134, 136, 138 of the frame 214 of the flexible bag 212 may be registered and secured during use. The outwardly extending projections 132, 134, 136, 138 of the frame 214 are shown in FIG. 14. The plurality of recesses 133 in the housing 12 receive the respective projections 132, 134, 136, 138 in such a manner that the bag frame 214 is secured against rotation relative to the cylindrical recess 115 within the housing 12. The bag frame 214 is securely oriented and aligned in a horizontal position, such as shown in FIG. 9, when the projections 132, 134, 136, 138 are received within the respective recesses 133.

The first support structure 200 is positioned at the lower end of the cylindrical recess 115 and includes retaining projections 135 in each of the respective recesses 133 for releasably locking the respective projection 132, 134, 136, 138 within the respective recess 133. The retaining projections 135 may be fabricated from a substantially rigid plastic material and are integral with the housing 12 of the diaper pail assembly 10.

Figure 15:
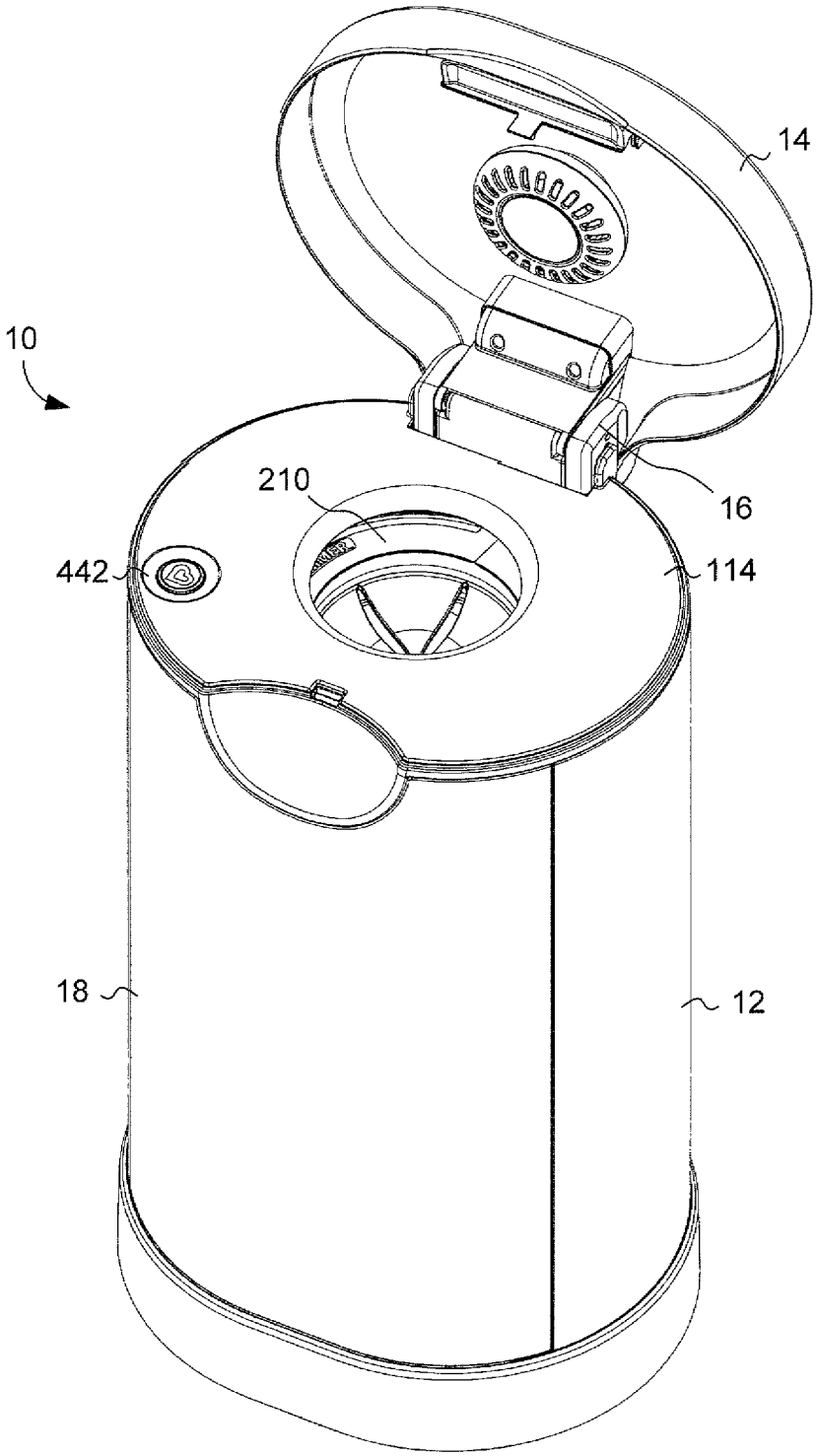
FIG. 15 shows a top perspective view of the pail assembly with the internal lid disposed over the housing.

In use, the bag frame 214 of the flexible bag 212 is sufficiently flexible to permit the user to manipulate the bag frame 214 into and out of the secured position. Each of the projections 132, 134, 136, 138 on the bag frame 214 are positioned beneath the respective retaining projections 135 and secured in place. The flexible bag 212 of the flexible bag assembly 210 is pushed through the rotatable sealing and gripping mechanism 54 such that the majority of its volume is disposed in the interior storage space 13 within the chamber 12 as shown in FIG. 9. As shown in FIG. 15, the internal lid 114 is closed over the waste chamber 113 and an item of waste can be pushed through the twisted portion 121 formed in the flexible bag 212 of the flexible bag assembly 210.

The second support structure 300 is also defined by the cylindrical recess 115 within the waste chamber 113. The walls of the cylindrical recess 115 define the outer boundary for the cassette 314 such as shown in FIG. 10. As shown in FIGS. 10 and 18, the flexible tubing 312 is drawn from within the cassette 314 and fed out of the cassette 314 and through the rotatable sealing and gripping mechanism 54 while in use. A knot may be tied at the lower end of the flexible tubing 312 to construct a closed lower end bag enclosure to seal off the lower end of the flexible tubing 312 to form a container.

Figure 16:
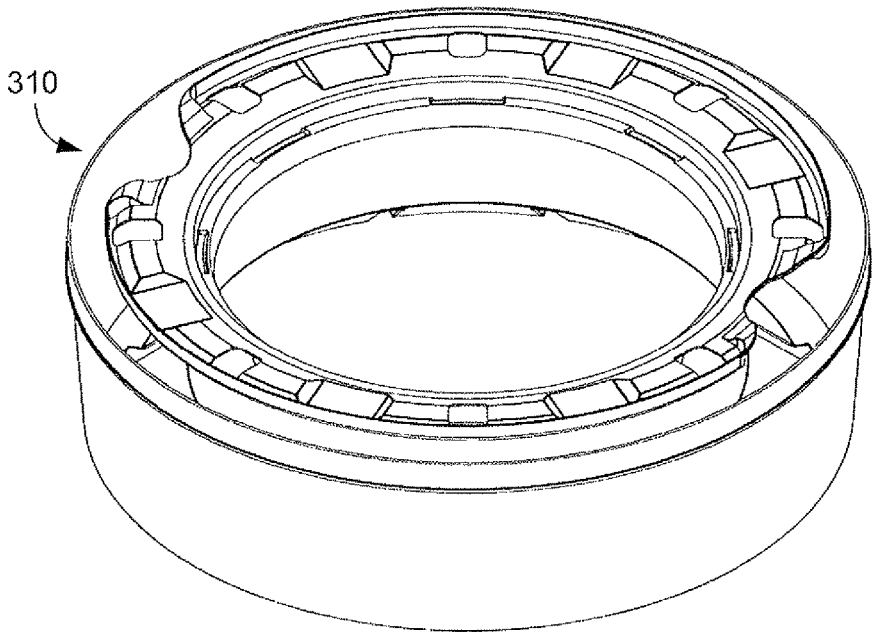
FIGS. 16-18 illustrate a top, bottom and cross section view of an exemplary cassette.
Figure 17:
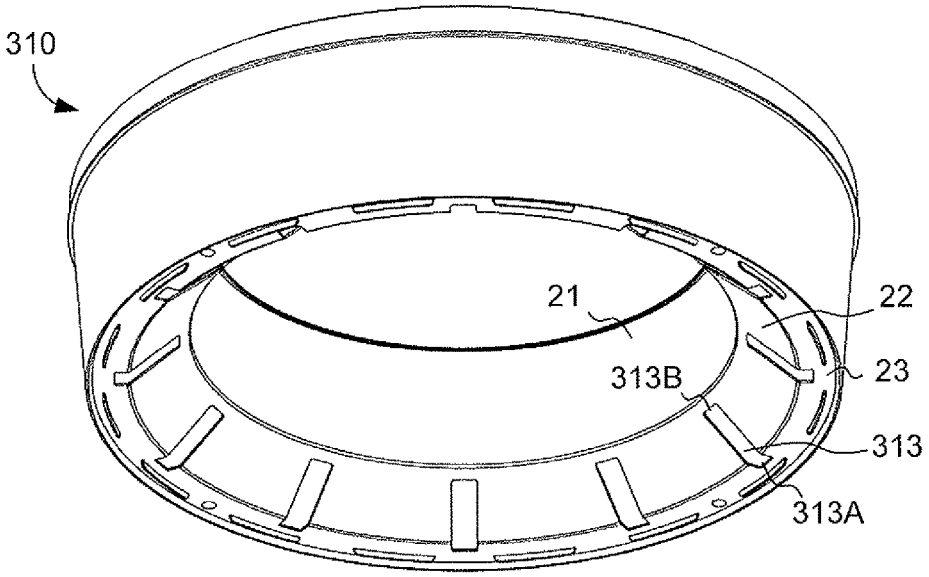

An exemplary cassette 314 that may be used in the diaper pail assembly 10 is shown in top and bottom perspective view in FIGS. 16-17, and side cross section view in FIG. 18. The cassette for dispensing pleated tubing may be provided as described in U.S. patent application Ser. No. 62/078,915, filed Nov. 12, 2014, or the cassette as described in co-pending U.S. patent application Ser. No. 13/688,139, filed Nov. 28, 2014, the entire disclosure of which are hereby incorporated by reference as if set fourth fully herein.

FIGS. 16-18 depict upper and lower perspective views of the cassette 314 into which a pleated flexible tubing 312 is received, as shown in FIG. 18. A plurality of apertures 313 is disposed in a radial configuration at the lower end of the cassette 314. As shown, the apertures 313 may be elongated, radially extending inwardly lengthwise from a first end 313*a* disposed in a bottom wall 23, to a second end 313*b* inwardly extending adjacent to the intersection of the angular wall 22 and the inner wall 21. The apertures 313 may be cut into the angular wall 22 and the bottom wall 23 and disposed concentrically about in a radial pattern.

The apertures 313 provide various advantages. First, during installation of the air-tight packing of the flexible packed tubing 312 into the U-shaped lower annular body of the cassette 314, the various apertures 313 serve as vent holes allowing air trapped below the packed tubing to vent out of the lower annular body through the apertures 133.

Alternatively, another significant advantage to the apertures 313 is the ability to control the rotation of the cassette 314. For example, FIG. 17 shows the apertures 313 functioning as key holes into which a mating key 60 may be aligned and disposed. The key 60 is attached to a portion of the housing 12. As shown, a laterally extending portion of a support structure attached to the housing 12 includes an upwardly projecting key 60 that mates with at least one of the apertures 133. In position within the second support structure 300, the key 60 positioned within one of the apertures 133 prevents the cassette 314 from being rotated while is use. The key 60 is constructed to be aligned to mate with at least one of the apertures 133. The key 60 may engage any portion of the aperture 133 and cause the cassette 314 to rotate, or prevent the cassette 314 from rotating by arresting the movement of the cassette 314.

Figure 20:
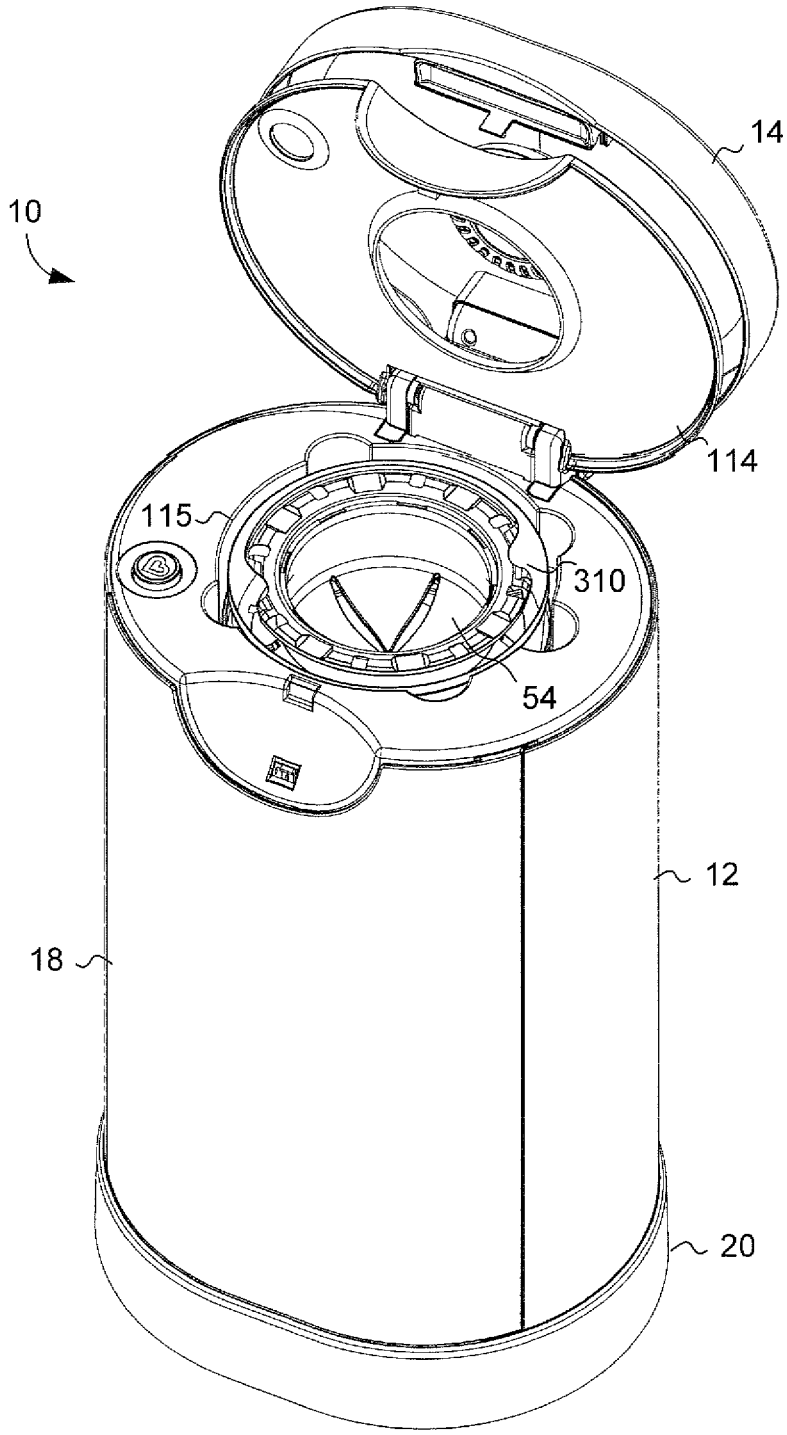
FIG. 20 shows a top perspective view of the cassette positioned within the second support structure of the pail assembly.
Figure 21:
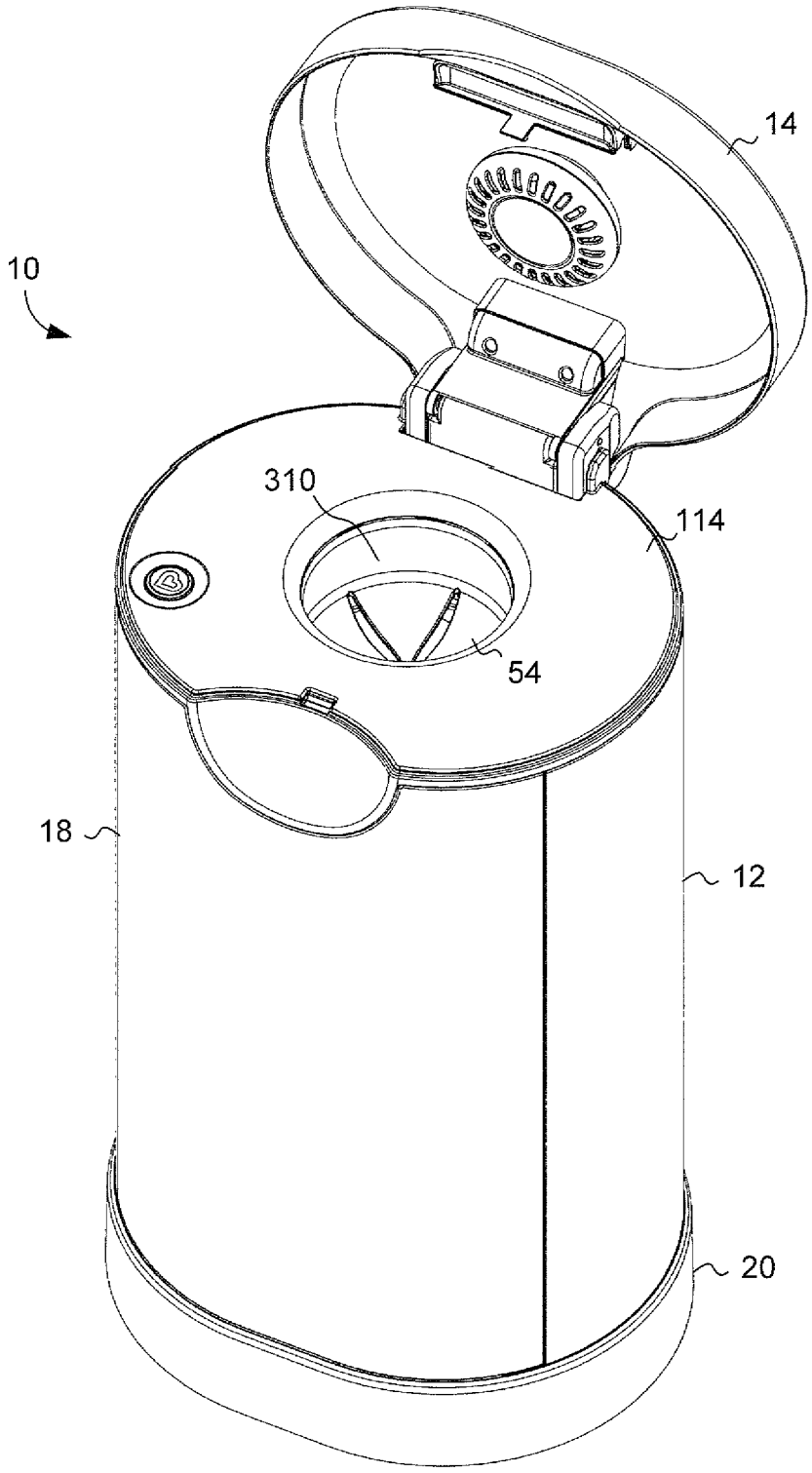
FIG. 21 illustrates a top perspective view of the cassette positioned within the second support structure and the internal lid of the pail assembly.

In use, the cassette 314 is positioned within the cylindrical recess 115 of the housing 12 such as shown in FIG. 20. In position, the protruding key 60 of is aligned with and inserted into at least one aperture 133. The internal lid 114 is locked into position over the cassette 314 and the flexible tubing 312 is secured in position as shown in FIG. 21.

Figure 22:
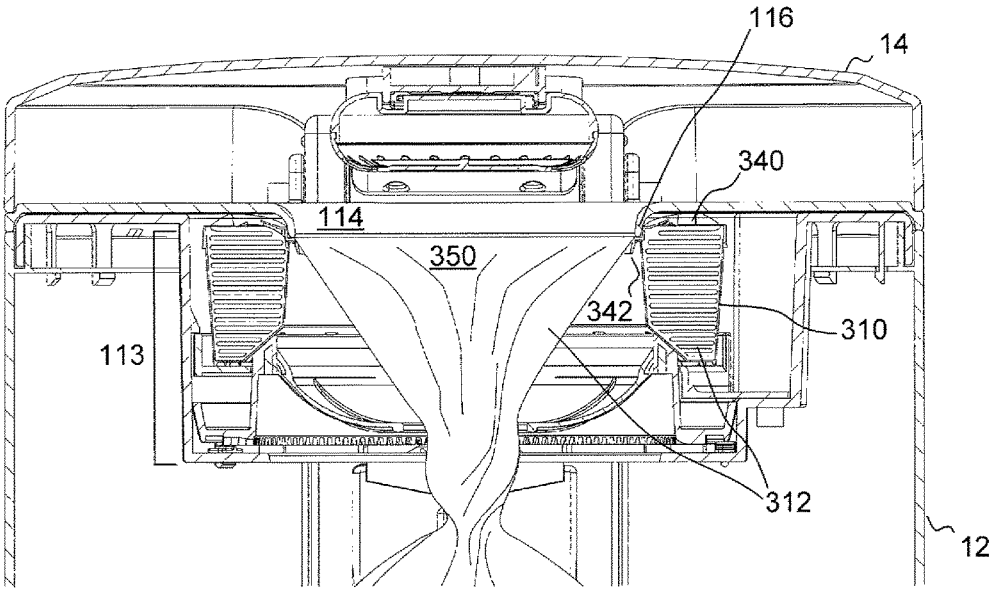
FIG. 22 depicts an enlarged cross section view of the cassette positioned within the second support structure of the pail assembly.
Figure 23:
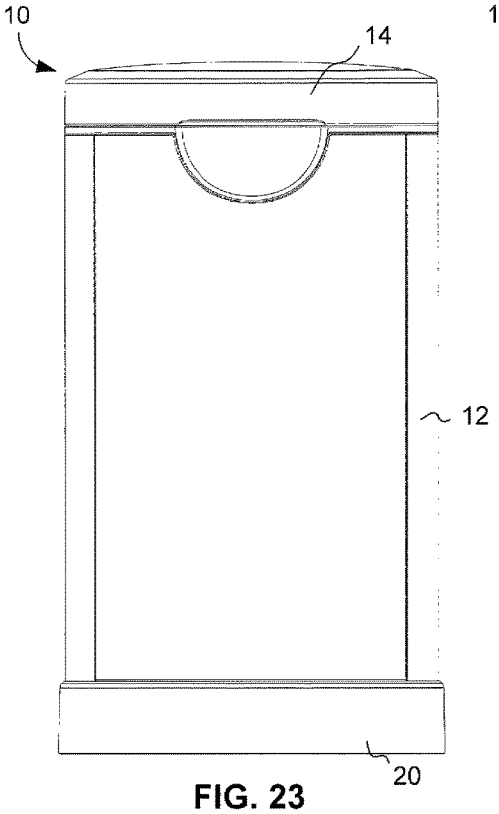
FIG. 23 shows a front view of the pail assembly.
Figure 24:
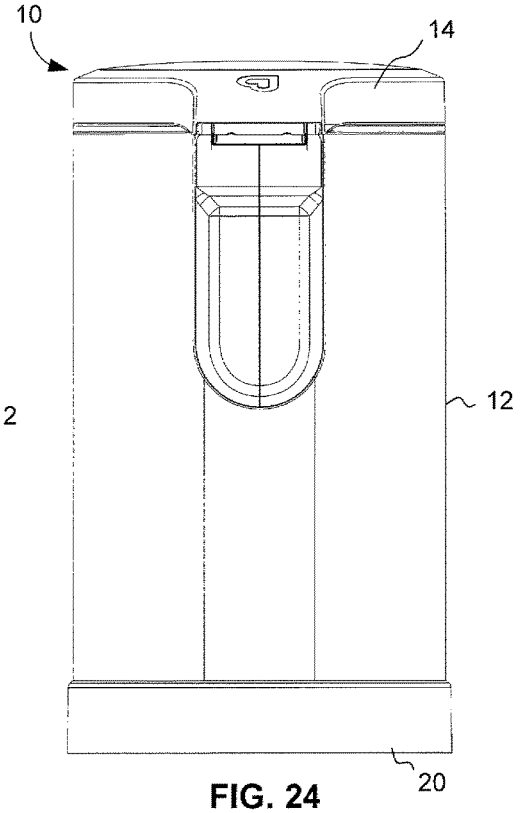
FIG. 24 illustrates a rear view of the pail assembly.
Figure 25:
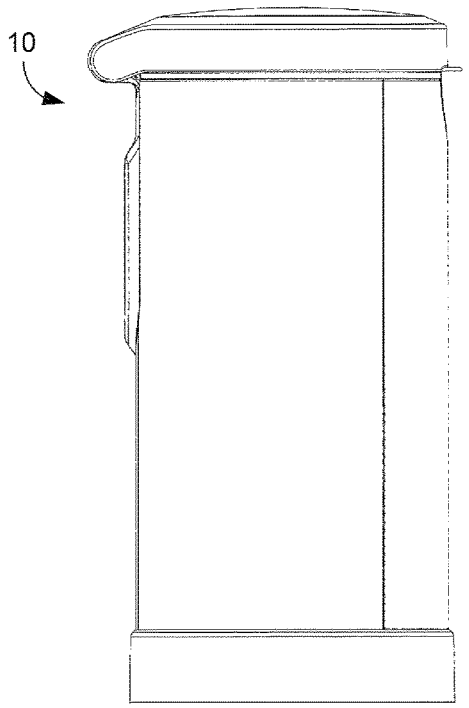
FIGS. 25-28 depict a left, a right, a top and bottom view of the pail assembly.
Figure 26:
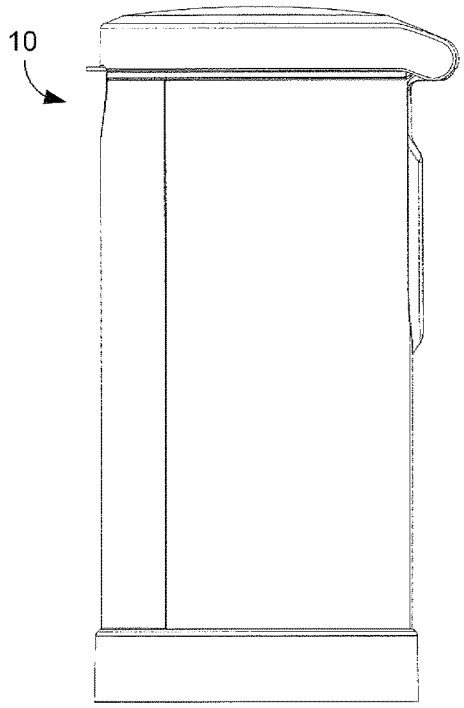
Figure 27:
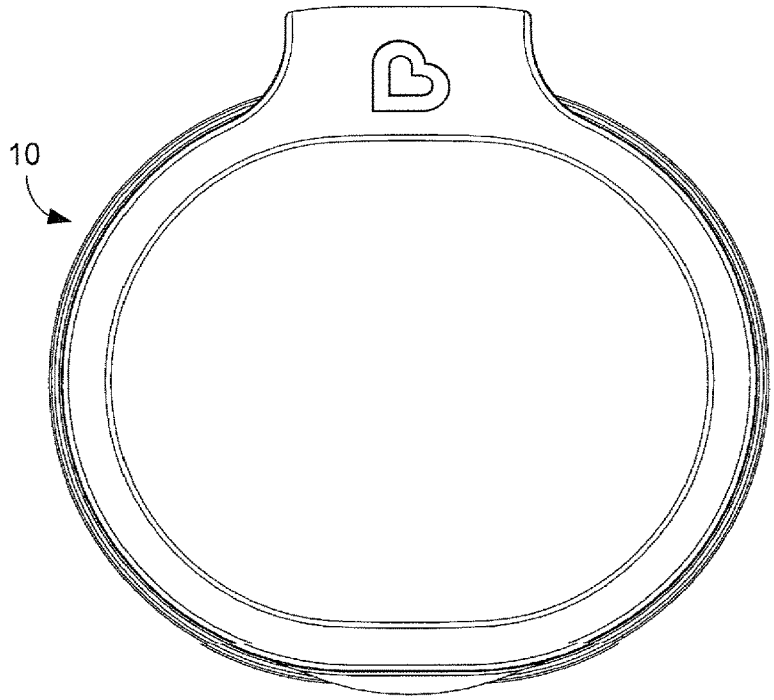
Figure 28:
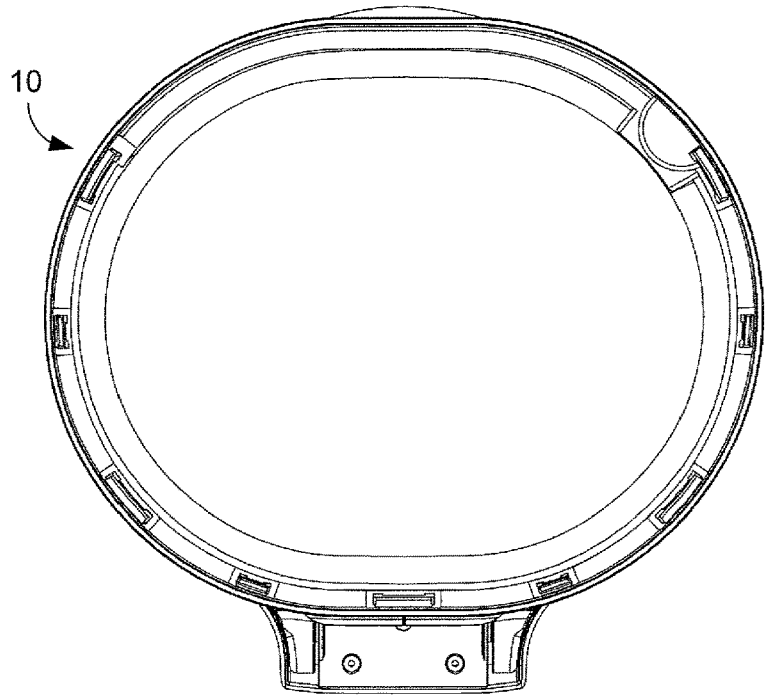
Figure 29:
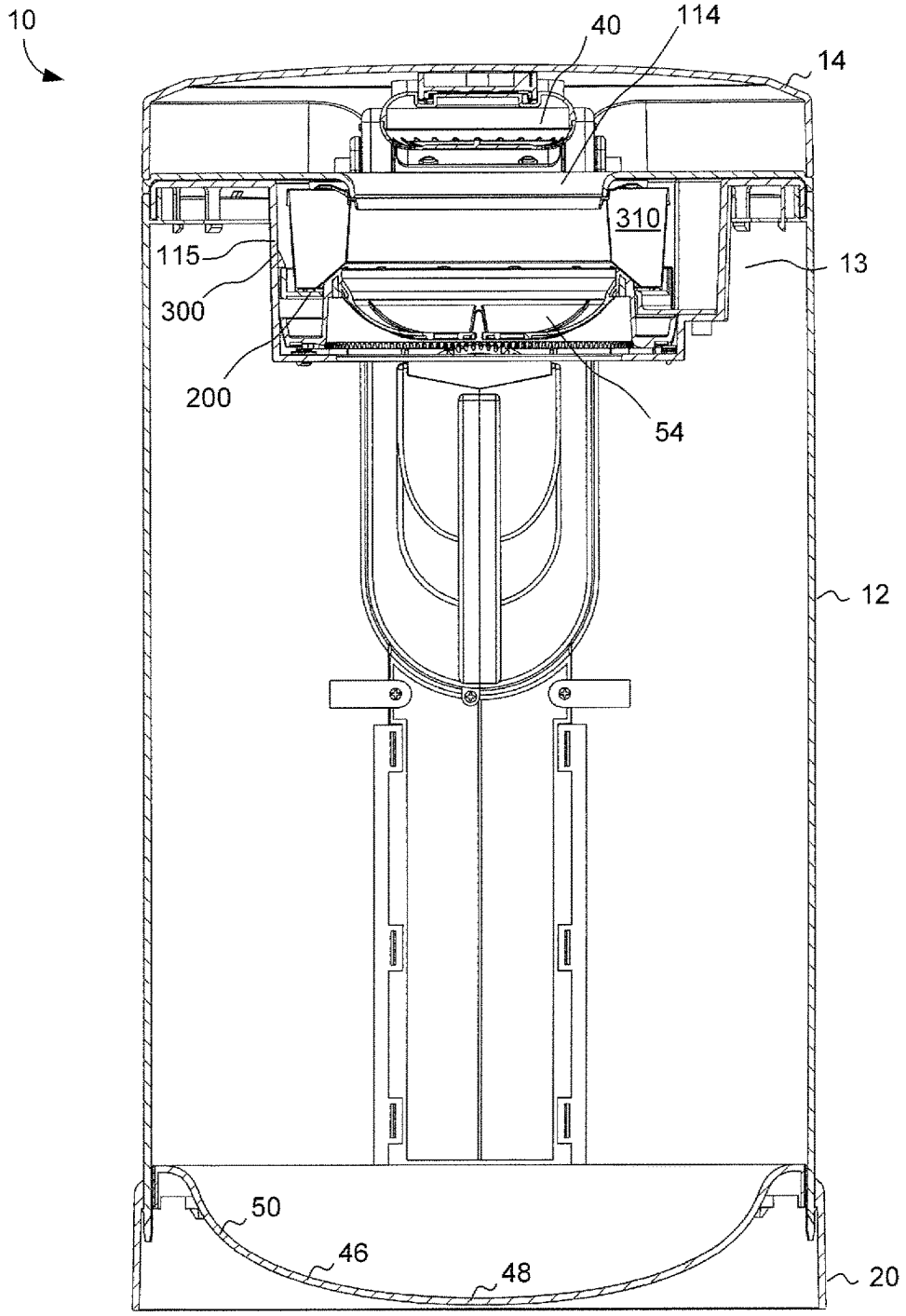
FIG. 29 shows a front cross section view of the pail assembly with the cassette disposed therein.
Figure 30:
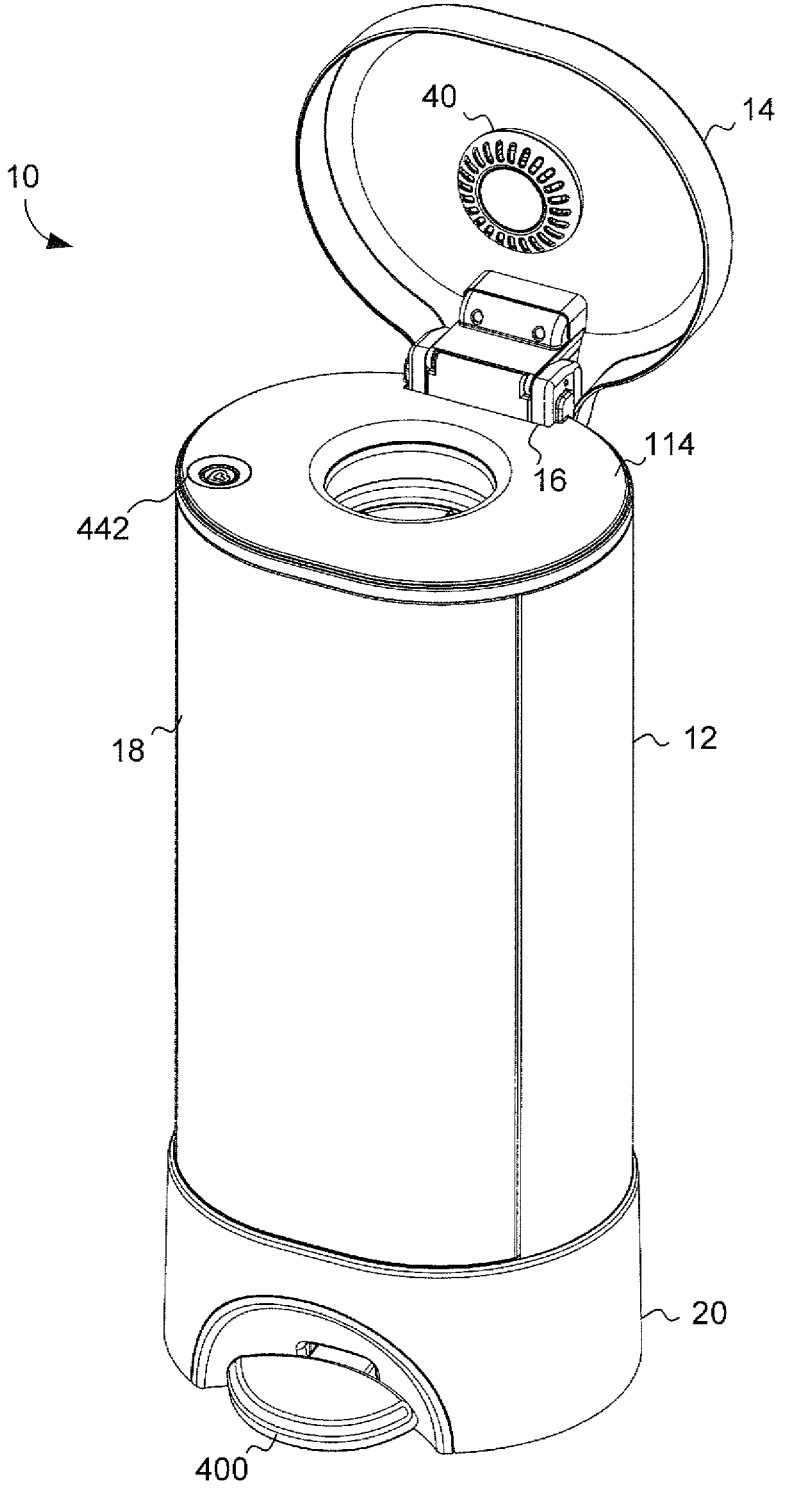
FIG. 30 depicts a front top perspective view of the pail assembly with foot pedal and lid open.
Figure 31:
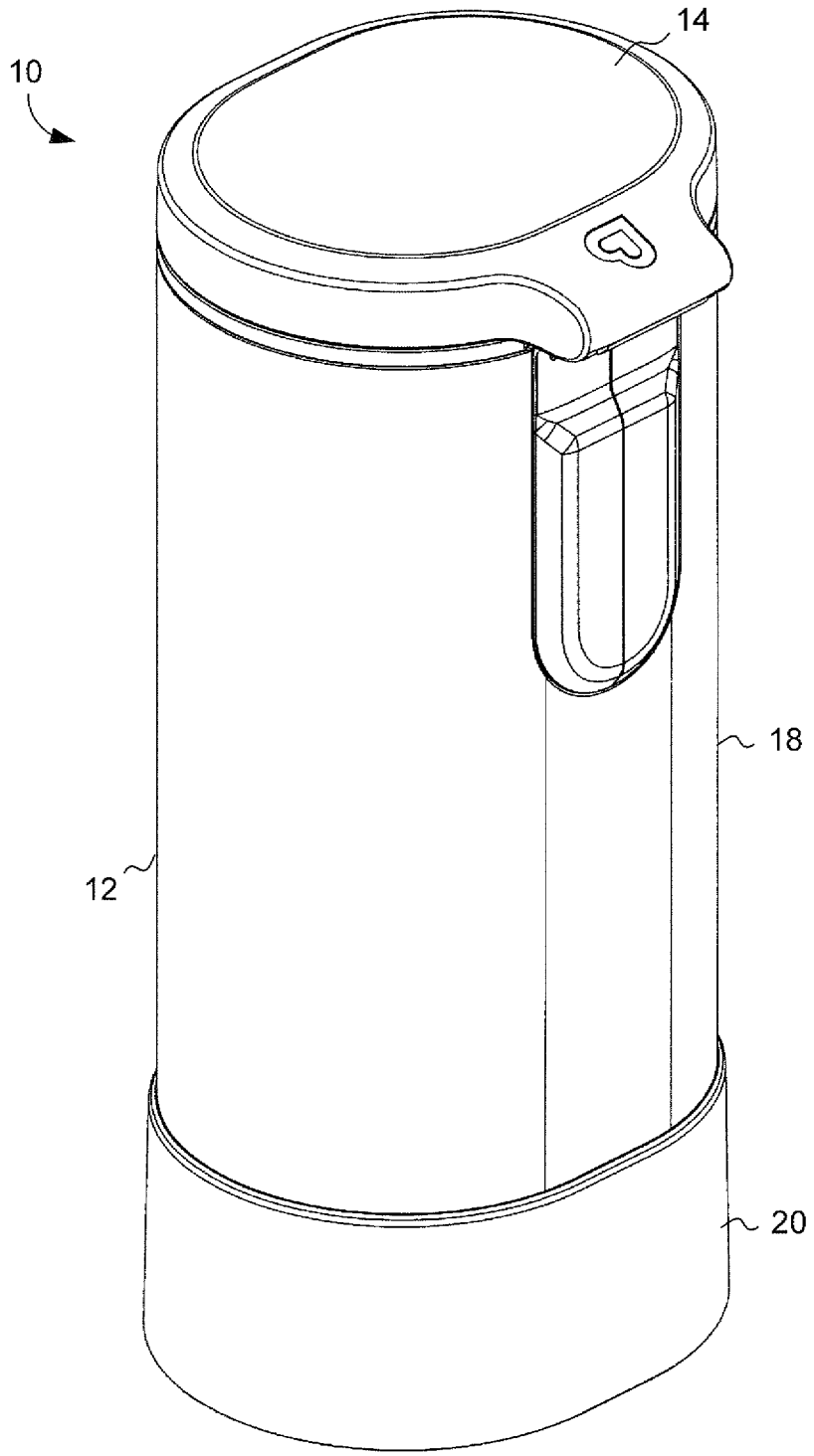
FIG. 31 depicts a back top perspective view of the pail assembly with foot pedal.
Figure 32:
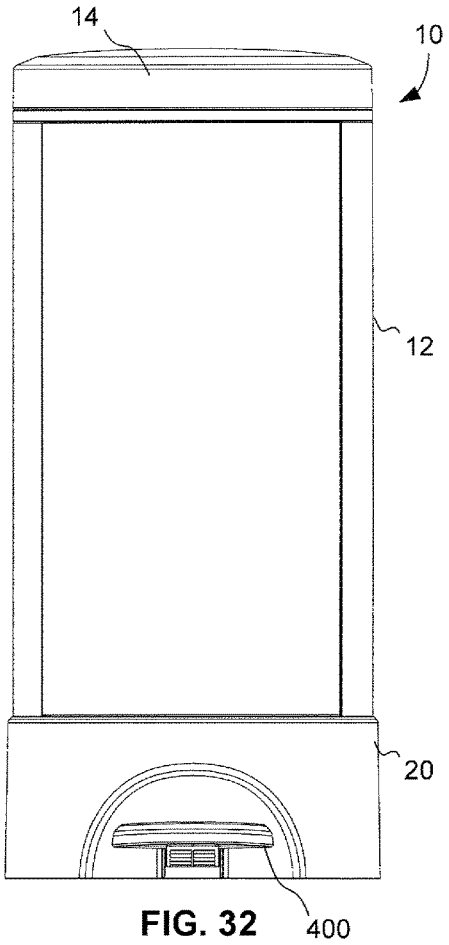
FIG. 32 shows a front view of the pail assembly with the foot pedal assembly.
Figure 33:
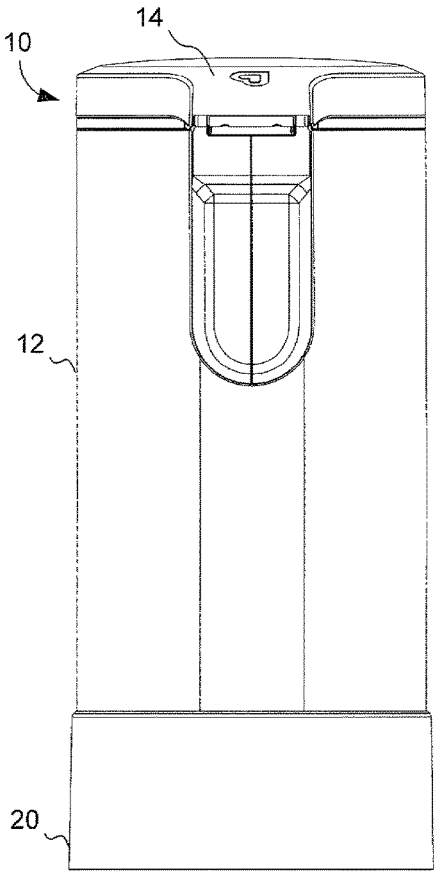
FIG. 33 illustrates a rear view of the pail assembly with the foot pedal assembly.
Figure 34:
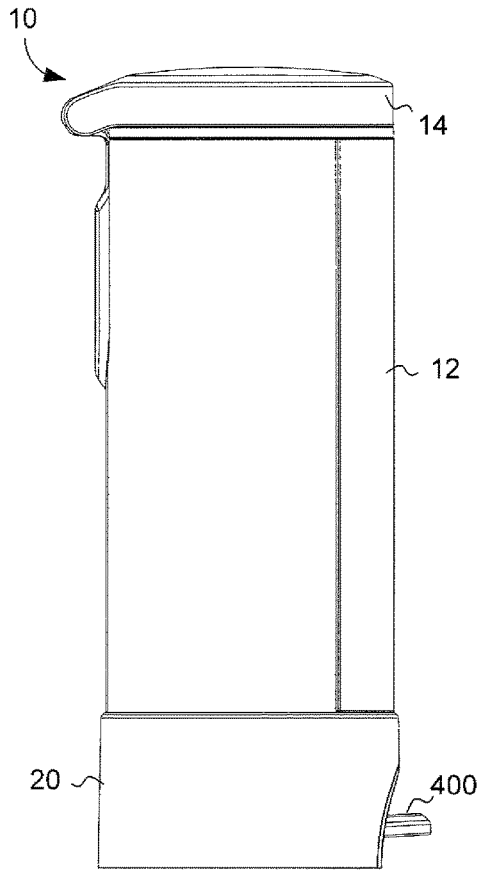
FIGS. 34-37 depict a left, a right, a top and bottom view of the pail assembly.
Figure 35:
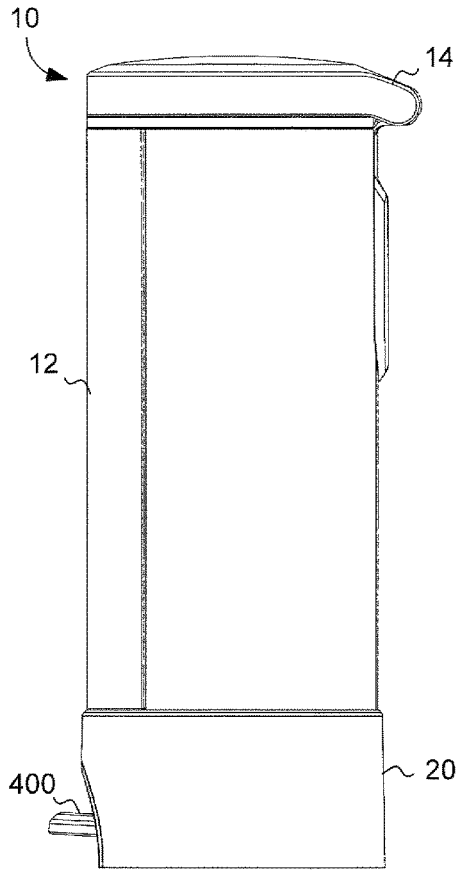
Figure 36:
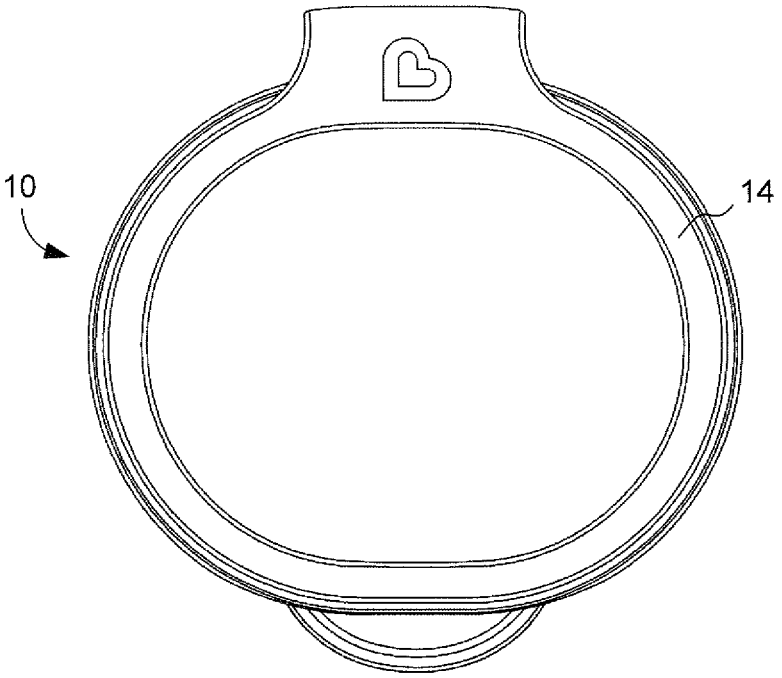

In detail, FIG. 22 depicts the interconnection between the internal lid 114, the cassette 314 and the flexible tubing 312 drawn from within the cassette 314. When the internal lid 114 is locked over the cassette 314 and the flexible tubing 312 is also secured in position, a slight compression force acts on the flexible tubing 312 to hold it in position at a junction where an inner curved portion 169 of the internal lid 114 is biased against an outer surface of the annular cover 340. In this manner, when a user pushes an article of waste through the opening 350 in the flexible tubing 312, the downward pressure of pushing the article of waste into the opening 350 in the flexible tubing 312 does not overcome the compression gripping force on the flexible tubing 312 between the inner curved portion 169 of the internal lid 114 and the outer surface 342 of the annular cover 340 thereby preventing any further tubing 312 from being pulled out of the cassette 314 while the internal lid 114 is closed shut.

The diaper pail assembly 10 may be constructed in a variety of different shapes and or sizes. FIGS. 23-29 illustrate front, rear, right, left side, top, bottom and a cross section view of one exemplary embodiment for the diaper pail assembly 10. In an alternative construction, the diaper pail assembly 10 may be embodied with a foot pedal mechanism 400. FIGS. 30-38 perspective, illustrate front, rear, right, left side, top, bottom and a cross section view of another exemplary embodiment for the diaper pail assembly 10 including the foot pedal mechanism 400.

Figure 39:
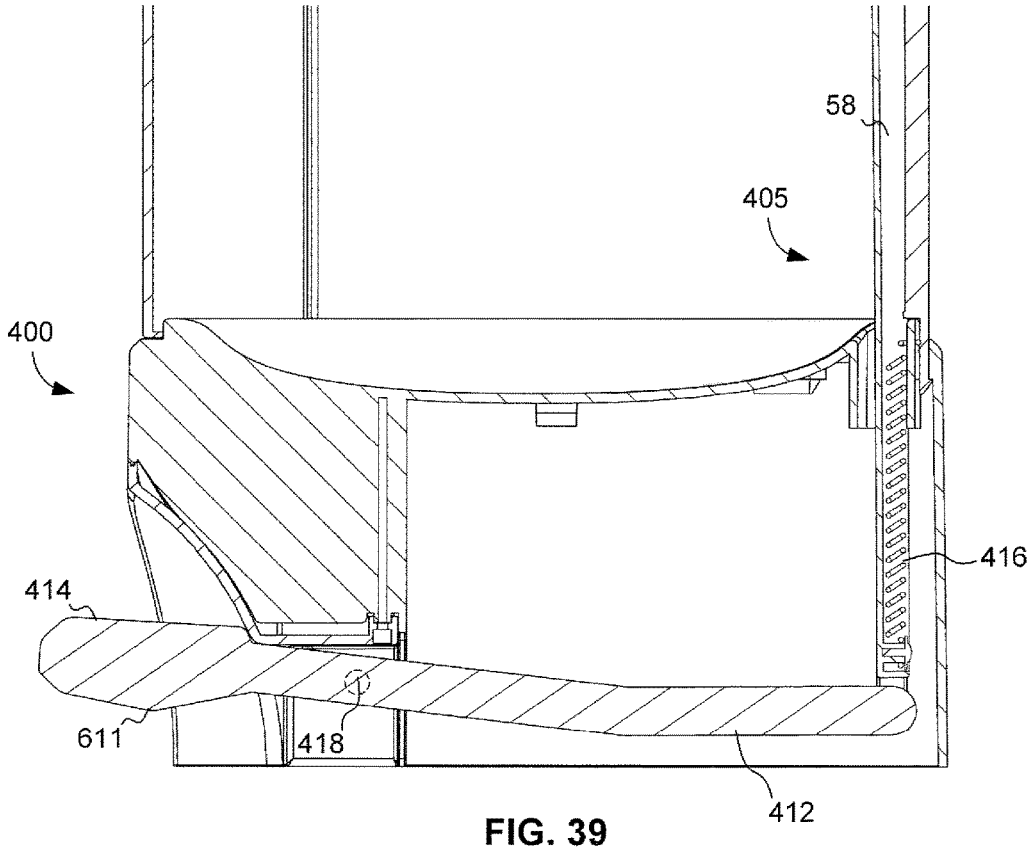
FIG. 39 illustrates a lower cross section view of the foot pedal assembly disposed in the pail assembly.

The foot pedal mechanism 400 may be used in the diaper pail assembly 10 such as shown in FIG. 39. The foot pedal mechanism 400 may utilize the basic structure of the lower end of the foot pedal mechanism such as shown in U.S. Pat. No. 2,910,206 (expired), the entire disclosure of which is hereby incorporated by reference as if set fourth fully herein.

As shown in FIG. 39, the pedal bar 412 has a fulcrum 418 at a midpoint to pivot the pedal bar 412 in a seesaw motion when the foot pedal 414 disposed at a first end of the foot pedal mechanism 400 is depressed. A push rod connection mechanism 405 includes a secure mating connection between a first vertical bar 416 and the second vertical bar 58. The push rod connection mechanism 405 is attached to a second end of the foot pedal bar 412 and translates upward when the first end of the foot pedal mechanism 400 is depressed. The upward motion of the first vertical bar 416 is attached by the secure mating connection to the upper second vertical bar 58. The upper end of the second vertical bar 58 engages the lid 14 and forces the lid 14 open when the foot pedal 414 is depressed.

FIGS. 38-43 depict various images of the push rod connection 405 between the first vertical bar 416 and the second vertical bar 58. The lower first vertical bar 416 is in communication with a depressible projection 414. The peripheral end of the lower first vertical bar 416 has a tapered end 422.

Figure 41:
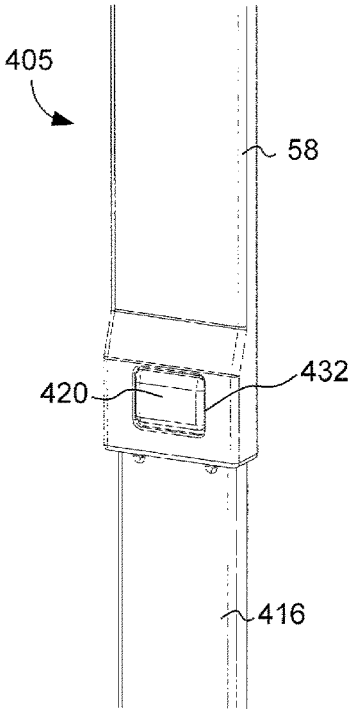
FIGS. 40-43 depict various views of an upper and lower push rod of a push rod connection in the pail assembly.
Figure 40:
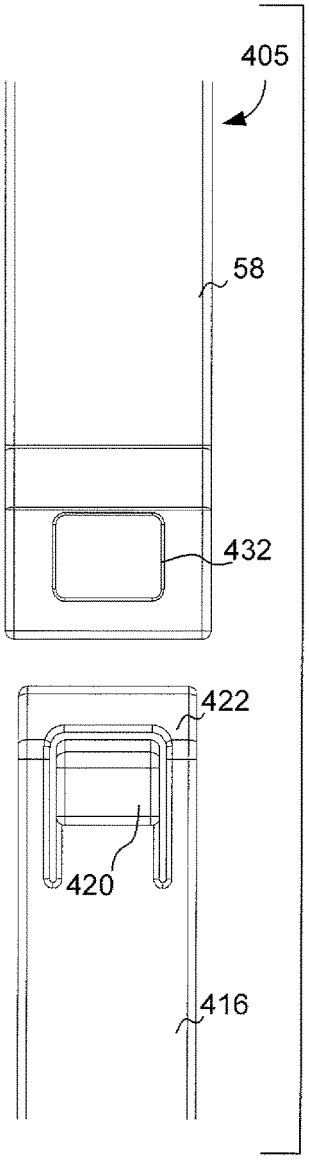
Figure 42:
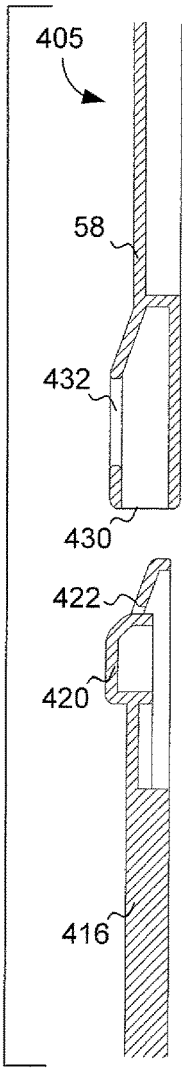
Figure 43:
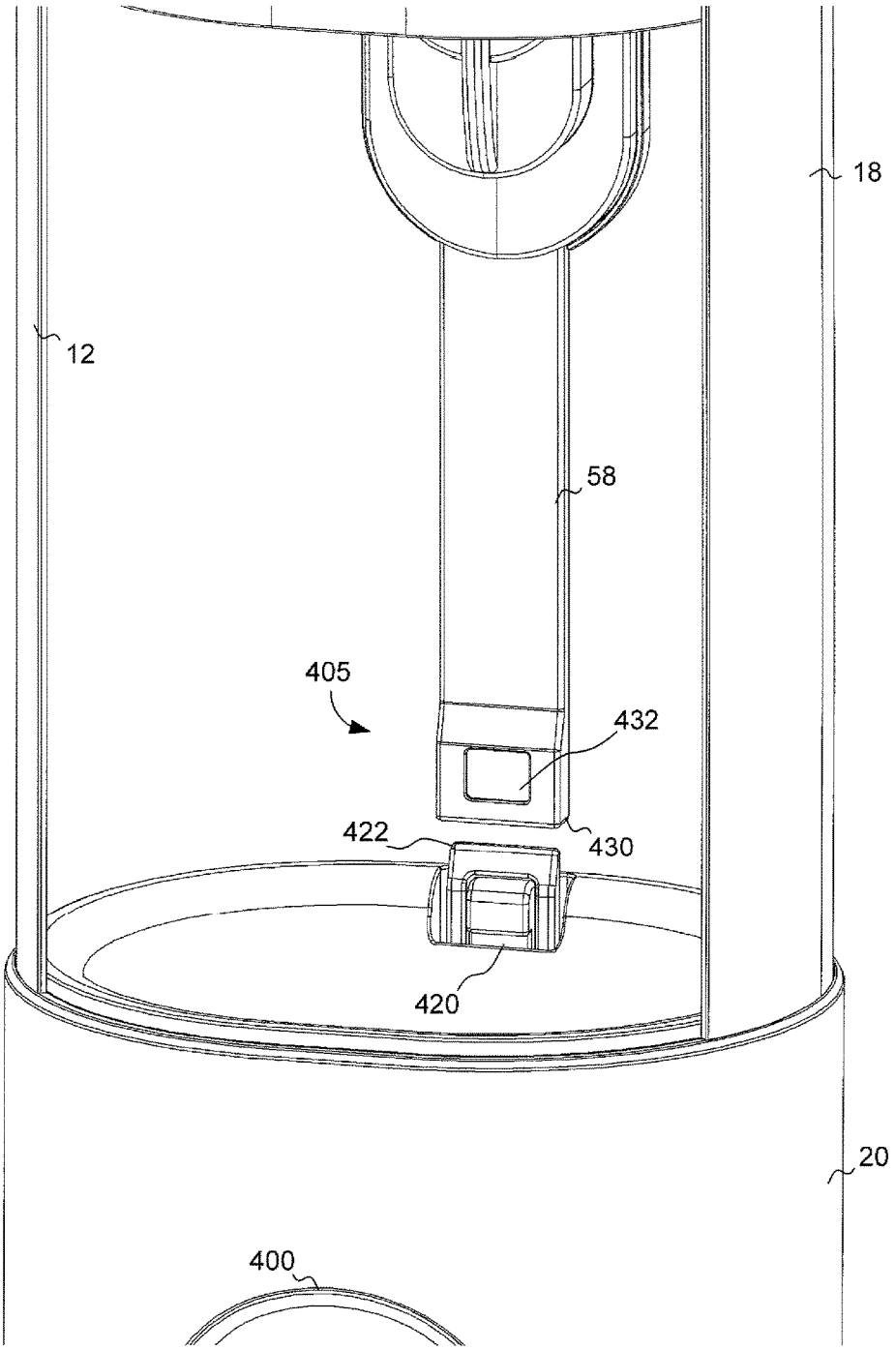

The second vertical bar 58 includes a lower open end 430 adapted to receive the tapered end 422 of the first vertical bar 416. The second vertical bar 58 includes an opening 432 into which the projection 420 may slide into such as shown in FIG. 41.

The embodiment show in FIGS. 40-43 allow for the housing 12 and base portion 20 to be separately manufactured and shipped disconnected. They may easily by connected using the seat belt locking mechanism shown in these figures. Disconnection is simply initiated by depressing the projection 420 from the opening 432 to disengage the connection between 58 and 416, thereby separating the body portion 12 from base portion 20.

FIGS. 1-2 and 44-46 illustrate a button 442 for an exemplary door latching mechanism 440. When the button 442 is depressed, the door latching mechanism 440 is engaged and the door 18 on the housing 12 may be released for access into the interior storage space 13 portion of the housing 12.

Figure 44:
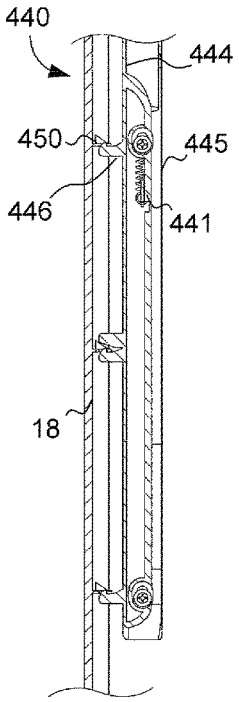
FIGS. 44-46 show various views the door latching mechanism in the pail assembly.
Figure 45:
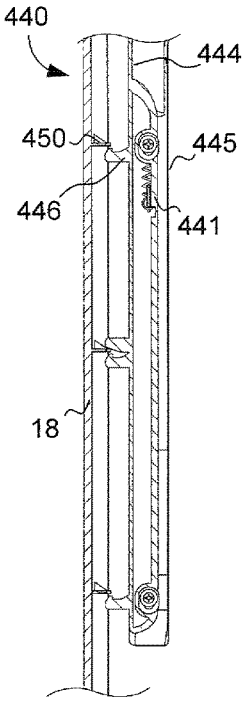
Figure 46:
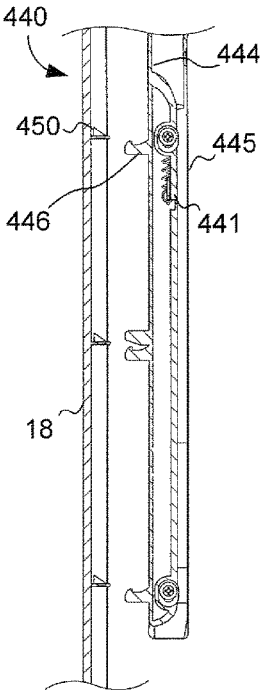

As shown in FIGS. 44-46, the door latching mechanism 440 includes a vertical post 444 connected to the button 442 that translates along a guide 445. The vertical post 444 includes at least one male latch 446 that can be removably latched to a female locking opening 450 disposed on the door 18 of the housing 12. In use, the vertical post 444 moves downward when the button 442 is depressed a predetermined distance so that the latch 446 can clear the catch 450. Spring 441 maintains the guide 445 in an upward position until the button 442 is pressed, thereby releasing the door latching mechanism 440 from the door 18.

Figure 47:
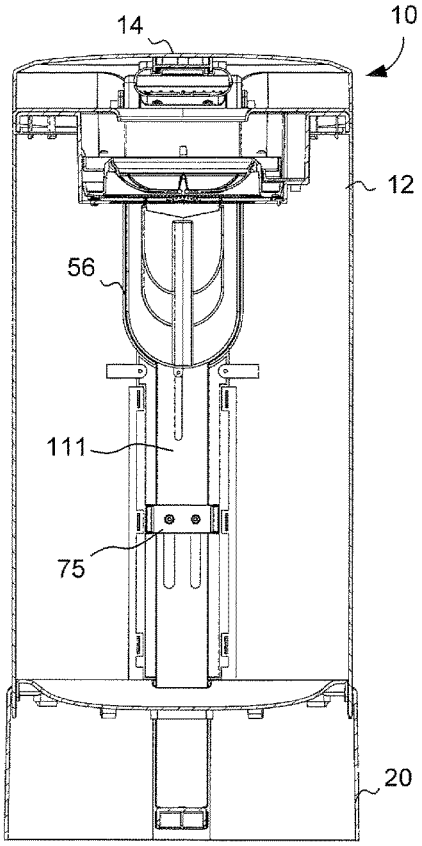
FIGS. 47-48 show a back and side cross section view of the pail assembly with the cassette and foot pedal disposed therein.
Figure 48:
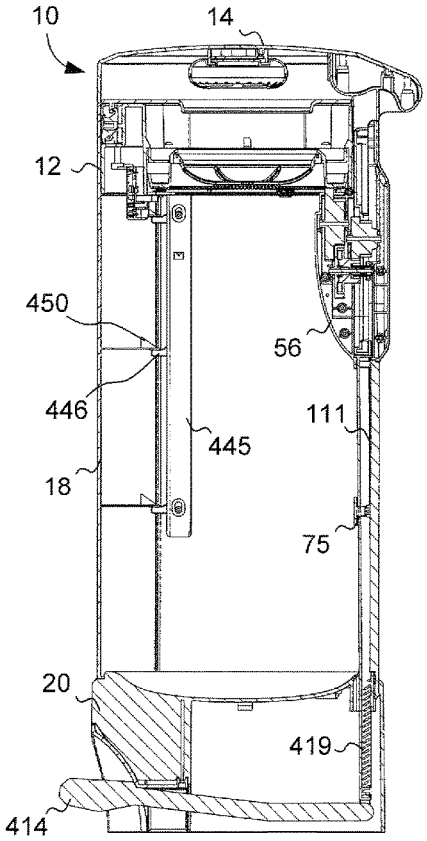
Figure 49:
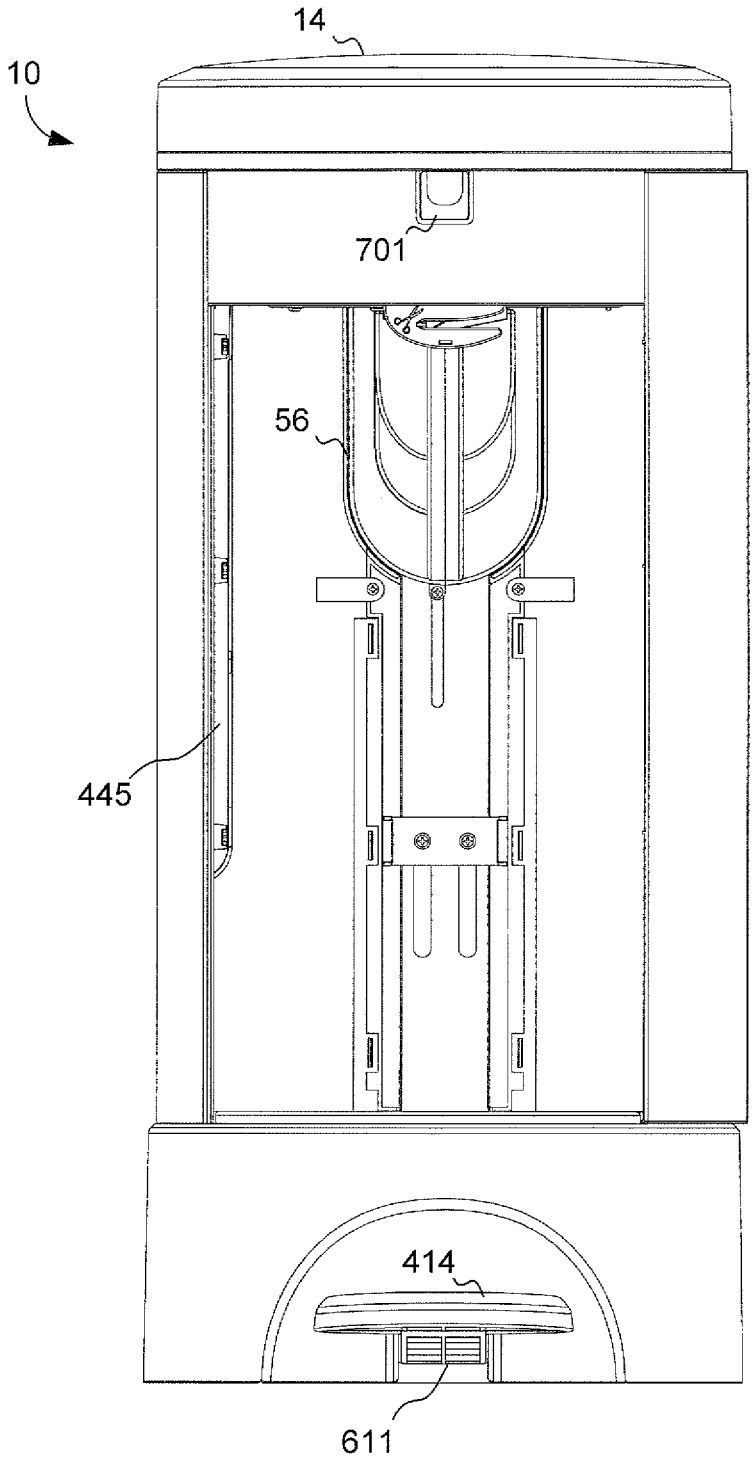
FIG. 49 shows a front cross section view of the pail assembly with the foot pedal mechanism disposed therein.

As shown in FIGS. 47-48, a single vertical foot pedal arm 111 may be used instead of the mechanism shown in FIGS. 40-43. In this embodiment, depressing of the foot pedal portion 414 serves to act against a downward force of spring 419 and push the foot pedal arm 111 in a vertical manner for a limited distance as determined by guide 11, which translates to the turning of the transmission mechanism 56 to open the lid 14.

Figure 37:
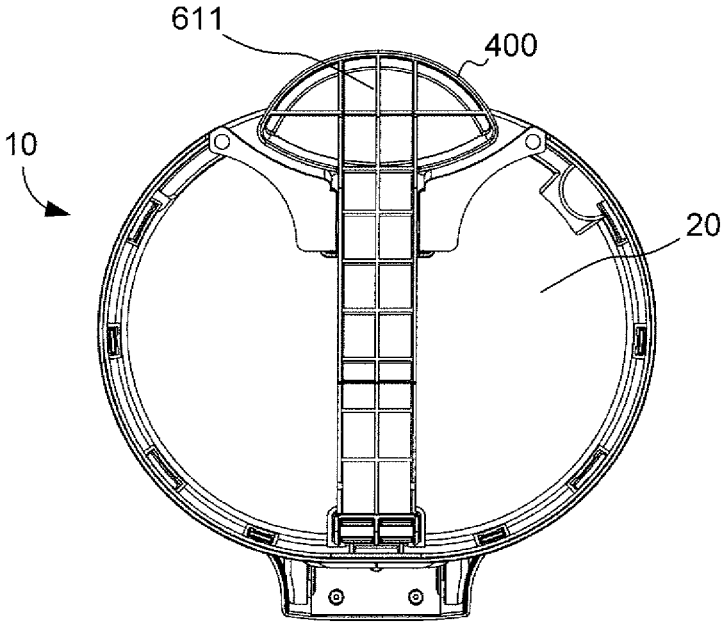
Figure 38:
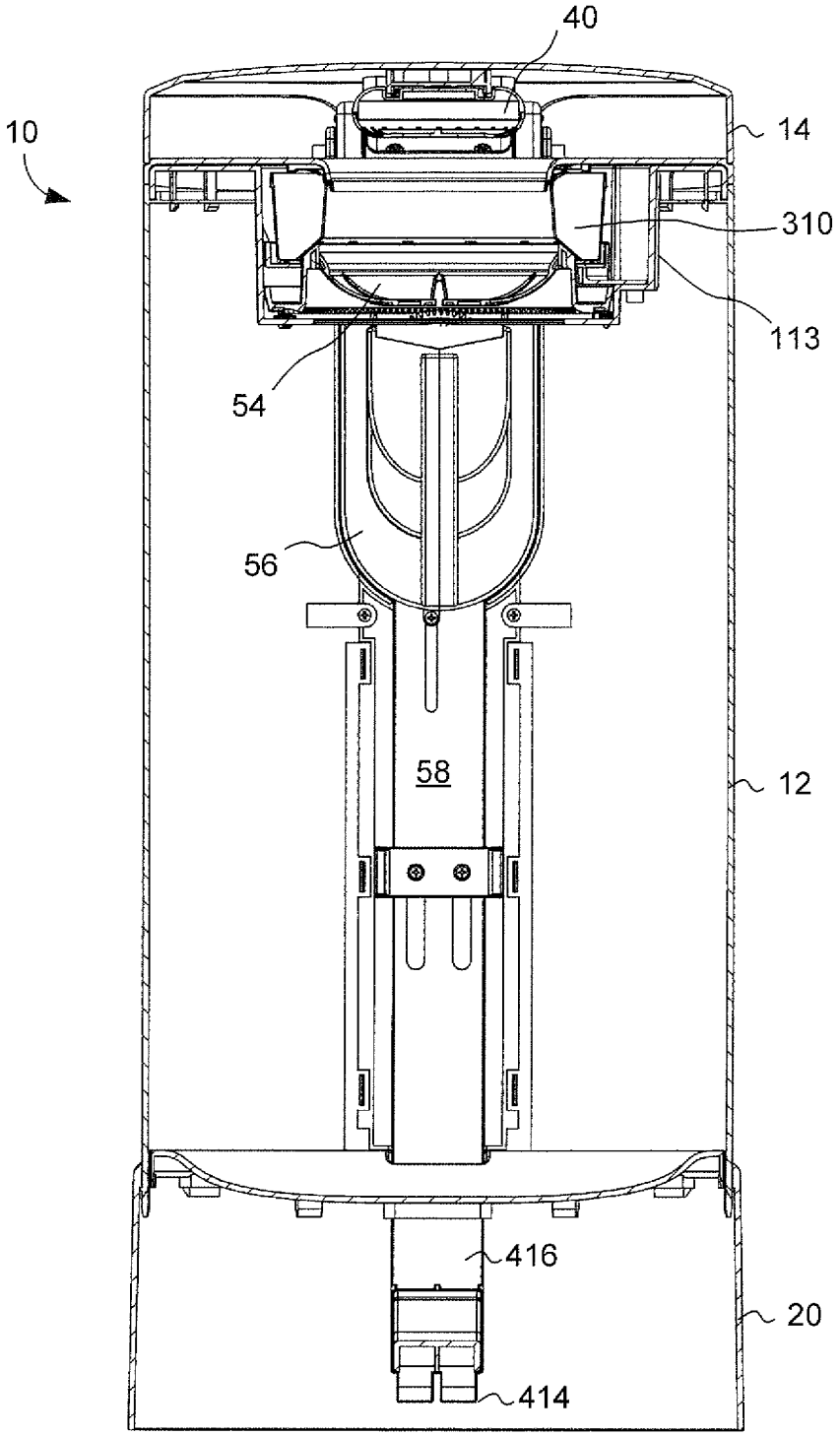
FIG. 38 shows a front cross section view of the pail assembly with the cassette and foot pedal disposed therein.

As shown in FIGS. 37, 39 and 48, foot pedal 414 has raised ribs 611 underneath it, which serve as a hard stop to ensure a limit to the downward movement of foot pedal 414. The extent of the ribs underneath the foot pedal 414 is only so much as to allow for the opening of the lid 14, but not so much as to flip the lid over and possibly tip the container 12. The raised ribs also serve to provide a stable constant surface with the floor upon full downward press of the foot pedal 414 such that the raised ribs are flush against a hard surface, or are buried into a soft surface, such as carpet. This feature allows for the activation of the opening of the lid 14 without tipping over the container 12.

As shown in FIGS. 49-52, the internal lid 114 may be released from its downward locked position upon depressing a latch button 701. Pushing the latch button 701 disengages its attached catch mechanism 702 from a receiving latch hook 703 on the interior lid 114. Further, the internal lid 114 contains a button accommodating orifice 704 which is designed to allow the user access to button 442 that releases the door 18, without having to open the internal lid 114.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed is:

1. A container, comprising:

a housing having a waste chamber configured to receive a waste disposal unit, the waste chamber comprising:

a first stationary support member adapted to receive a single-use bag of a flexible material attached to a frame, wherein the frame is releasably mounted to the housing and rotationally secured with respect to the housing; the first stationary support member further including recesses and tab clips therein to accommodate and secure specifically positioned tabs on the frame of the single-use bag; and a second stationary support member adapted to securely receive a cassette having a tubing of the flexible material packed therein;

protruding keys positioned in a base portion of the waste chamber; and a rotatable member having a resilient opening through which a passage of the flexible material is provided, where in use the rotatable member twists a portion of the flexible material to seal the passage closed.

2. The container of claim 1, further comprising a receiving well with a depth such that the cassette can be received in its entirety within the receiving well.

3. The container of claim 1, wherein the protruding keys are configured to mate with apertures located on an underside of the cassette to prevent the cassette from moving once placed into the waste chamber.

4. The container of claim 1, wherein the protruding keys are configured to displace a portion of the frame of the single-use bag by contact with one side of the frame while the tab clips positioned within the recesses in the first stationary member contact an opposite side of the frame from the protruding keys to secure the single-use bag in place.

5. The container of claim 1, further comprising a top lid attached to the housing through a lid hinge.

6. The container of claim 5, wherein the top lid is openable upon pressing of a pedal in connection to the housing.

7. The container of claim 6, wherein the pedal includes ribs on its underside which fully contact a ground surface upon complete pressing of the pedal and provide structural stability to the housing when the top lid is opened.

8. The container of claim 5, wherein the top lid includes a deodorizing chamber for housing a deodorizer.

9. The container of claim 5, further comprising a transmission mechanism adapted to rotate the rotatable member.

10. The container of claim 9, wherein the transmission mechanism is initiated by closing the top lid.

11. The container of claim 1, further comprising an internal lid attached to the housing through the lid hinge, and which provides access to the waste chamber.

12. The container of claim 11, wherein the internal lid is openable upon pressing of a latch in the housing.

13. The container of claim 11, wherein the internal lid includes an open aperture with access to the waste chamber when the internal lid is closed.

14. The container of claim 13, wherein the open aperture of the internal lid has a curved edge directed internally to the waste chamber, the curved edge contacts a portion of the cassette such that the cassette is securely positioned in place when the internal lid is closed.

15. The container of claim 14, wherein the curved edge of the internal lid applies enough pressure to the cassette that the tubing of flexible material remains in place when waste material is inserted into the rotatable member.

16. A container, comprising:

a housing having a waste chamber configured to receive a waste disposal unit, the waste chamber comprising:

a first stationary support member adapted to receive a single-use bag of a flexible material attached to a frame, wherein the frame is releasably mounted to the housing and rotationally secured with respect to the housing; the first stationary support member further including recesses and tab clips therein to accommodate and secure specifically positioned tabs on the frame of the single-use bag; and a second stationary support member adapted to securely receive a cassette having a tubing of the flexible material packed therein; and protruding keys positioned in a base portion of the waste chamber.

17. The container of claim 16, further comprising a rotatable member having a resilient opening through which a passage of the flexible material is provided, where in use the rotatable member twists a portion of the flexible material to seal the passage closed.

18. A container, comprising:

a housing having a waste chamber configured to receive a waste disposal unit, the waste chamber comprising:

a first stationary support member having recesses and tab clips therein to accommodate and rotationally secure specifically positioned tabs on a frame of a single-use bag, wherein the frame is rotationally secured to the housing; and a second stationary support member having protruding keys positioned in a base portion adapted to rotationally secure a cassette having a tubing of the flexible material packed therein.

19. The container of claim 18, further comprising a rotatable member having a resilient opening through which a passage of the flexible material is provided, where in use the rotatable member twists a portion of the flexible material to seal the passage closed.

* * * * *